US007825760B2

(12) United States Patent
Bird et al.

(10) Patent No.: US 7,825,760 B2
(45) Date of Patent: Nov. 2, 2010

(54) CONICAL MAGNET

(76) Inventors: Mark D. Bird, 8750 Cabin Hill Rd., Tallahassee, FL (US) 32311; Jack Toth, 16150 Star Hill Rd., Tallahassee, FL (US) 32310

( * ) Notice: Subject to any disclaimer, the term of this patent is extended or adjusted under 35 U.S.C. 154(b) by 194 days.

(21) Appl. No.: 12/287,278

(22) Filed: Oct. 8, 2008

(65) Prior Publication Data

US 2010/0033280 A1 Feb. 11, 2010

Related U.S. Application Data

(63) Continuation-in-part of application No. 11/517,229, filed on Sep. 7, 2006, now abandoned.

(51) Int. Cl.

| | |
|---|---|
| ***H01F 5/00*** | (2006.01) |
| ***H01F 1/00*** | (2006.01) |
| ***H01F 3/00*** | (2006.01) |
| ***H01F 7/00*** | (2006.01) |
| ***H01F 6/00*** | (2006.01) |
| ***H01F 27/28*** | (2006.01) |

(52) U.S. Cl. ..... 335/299; 335/216; 335/282; 335/296; 336/231

(58) Field of Classification Search ..... 335/216, 335/282, 296, 299; 336/231
See application file for complete search history.

(56) References Cited

U.S. PATENT DOCUMENTS

| | | | | |
|---|---|---|---|---|
| 3,227,930 | A * | 1/1966 | Hnilicka, Jr. | 335/216 |
| 3,376,528 | A * | 4/1968 | Macy | 335/296 |
| 3,735,188 | A * | 5/1973 | Anderson et al. | 315/3.5 |
| 4,359,706 | A * | 11/1982 | Flack | 335/281 |
| 5,581,220 | A * | 12/1996 | Rodenbush et al. | 335/216 |
| 5,799,653 | A * | 9/1998 | Carlson | 600/410 |
| 7,015,779 | B2 * | 3/2006 | Markiewicz et al. | 335/299 |
| 2003/0184427 | A1 * | 10/2003 | Gavrilin et al. | 336/200 |

* cited by examiner

*Primary Examiner*—Elvin G Enad
*Assistant Examiner*—Mohamad A Musleh
(74) *Attorney, Agent, or Firm*—J. Wiley Horton

(57) ABSTRACT

An electromagnet having a conical bore. The conical bore is created by wrapping a conductor around a conically-offset helix. The cross sectional area of the conductor can be varied in order to maintain a desired current carrying capacity along the helix. A single element can be used as the conductor. The conductor can also be created by stacking a series of specially-shaped plates analogous to prior art Bitter-disks.

8 Claims, 24 Drawing Sheets

CONICAL MAGNET

CROSS-REFERENCES TO RELATED APPLICATIONS

This is a continuation-in-part of U.S. application Ser. No. 11/517,229, which was filed on Sep. 7, 2006 now abandoned. The parent application listed the same inventors.

STATEMENT REGARDING FEDERALLY SPONSORED RESEARCH OR DEVELOPMENT

This invention was developed at the National High Magnetic Field Laboratory in Tallahassee, Fla. The research and development has been federally sponsored.

MICROFICHE APPENDIX

Not Applicable

BACKGROUND OF THE INVENTION

1. Field of the Invention

This invention relates to the field of electromagnets. More specifically, the invention comprises a magnet capable of producing an approximately conical field.

2. Description of the Related Art

The present invention proposes to create an electromagnet having a conical bore and, consequently, an approximately conical field. Several approaches may be useful for constructing such a magnet. It is therefore important for the reader to understand some known techniques for electromagnet construction.

A good discussion of prior art magnet construction techniques is found in an article authored by one of the present inventors: Mark D. Bird, "Resistive Magnet Technology for Hybrid Inserts," *Superconductor Science and Technology*, vol. 17, 2004, pp. R19-R33. The basic principle of an electromagnet is that a conductor must be wrapped around a central bore for one or more turns. Many turns are typically used. FIG. 3 shows an electromagnet created by wrapping conductor 100 around central bore 104 in a helical path. The two ends of the helical path may be provided with a flat 30 to facilitate mounting the coil. Gaps 28 between adjacent turns on the helical path are typically filled with an insulator of some sort to ensure that the current flows through the helical path. The version shown in FIG. 3 is known as a Florida helix 26. It can be manufactured by cutting the helical gap 28 through a solid cylinder of material, using a wire-EDM process. The resulting conductor is capable of carrying a substantial electric current. This current generates Lorentz forces and considerable heat. Other components are needed to accommodate these factors. Cooling holes or slots traveling parallel to central bore 104 are typically provided. The whole device is placed within a surrounding jacket, so that a pressurized cooling fluid can be pumped through the holes or slots. Mechanical attachment features are generally also provided. For purposes of visual clarity, these features have been omitted.

Bitter-disk type electromagnets are another approach to carrying high currents. While it is true that those skilled in the art are familiar with the design and construction of such magnets, a brief explanation of the prior art will be helpful in understanding the proposed invention.

FIG. 4 shows a prior art Bitter-disk magnet. End plate 40 is the anchoring point for a number of circumferentially-spaced tie rods 44. In practice tie rods 44 have uniform length. Some of these are shown cut away in order to aid visualization of other components. A Bitter-disk magnet is typically constructed by stacking the components. Starting with end plate 40, tie rods 44 are added. A series of conducting disks 36 are then slipped onto tie rods 44. The reader will observe that each conducting disk 36 has a series of holes designed to accommodate tie rods 44. Conducting disks 36 are made of thin conductive material, such as copper or aluminum.

Turning briefly to FIG. 6, the reader may observe conducting disk 36 in more detail. Tie rod holes 46 are uniformly spaced around its perimeter. Cooling holes 54 are also spaced about conducting disk 36.

Cut 52 is a radial cut extending completely through one side of the disk. The reader will observe that the two sides of the disk have been displaced vertically, with the result that conducting disk 36 forms one turn of a helix having a shallow pitch. Upper side 50 of cut 52 is higher than lower side 48. The importance of this fact will become apparent as the construction of the device is explained further.

Prior art Bitter magnets are made in several different ways. The specifics of the prior art construction techniques are not critical to the present invention, since the present invention could be constructed using any of the prior art techniques. However, in order to aid the understanding of those not skilled in the art, one of the prior art construction techniques will be discussed in detail:

Returning now to FIG. 4, the reader will observe that six conducting disks 36 are initially placed over tie rods 44 (the lowest part of the stack in the view). For the specific version shown, as each conductive disk is stacked, it is indexed 1/15 turn in the clockwise direction (corresponding to the fact that there are 15 tie rods 44). Turning to FIG. 7, the effect of the rotational indexing may be more readily observed.

Six conducting disks 36 have been assembled to create one conductor turn 42. Conducting disks 36 have also been "nested" together. The 1/15 turn is a somewhat arbitrary figure. They could be indexed in other increments. Rotational indexing as large as 1/3 turn is in common use, especially for smaller diameter stacks. In fact, it is more customary to divide the 360 degrees found in one complete turn into even increments. If six stacked conductors are used to make one turn, then it would be common to rotationally index each disk 1/6 turn over its predecessor (60 degree index per disk).

The disks are nested in the manner shown, so that upper side 50 of one conductor disk 36 lies over upper side 50 of the conductor disk 36 just below it. The disks in FIG. 4 are shown with a significant gap between them. The Bitter-disk assembly method squeezes the disks tightly together when the device is complete. When squeezed together, conducting disks 36 form one integral conductor having a helical shape—albeit with a very shallow pitch.

Returning now to FIG. 4, the description of the prior art device will be continued. The reader will observe that four conductor turns 42 are shown in the assembly (in the uncompressed state). In reality, many such conductor turns 42 will be stacked onto tie rods 44.

The desired result is to accommodate a large electrical current flowing through a helix having a shallow pitch. The desired path of current flow commences with one end plate 40 (which makes contact with the underside of the lowermost conducting disk 36). A second end plate 40 (not shown) will form the upper boundary of the assembly ("sandwiching" the other components in between). The current will then exit the device through the upper end plate 40 (The tie rods are electrically isolated from the end plates and the disks so that they will carry no current). Those skilled in the art will realize that if one simply stacks a number of conductor turns 42 on the device, the electrical current will not flow in the desired helix. Rather, it will simply flow directly from the lower end plate 40 to the upper end plate 40 in a linear fashion. An additional element is required to prevent this.

Insulating disks 34 are placed within each conductor turn 42 to prevent the aforementioned linear current flow. Each insulating disk 34 is made of a material having a very high electrical resistance. The dimensional features of each insulating disk 34 (tie rod holes, cooling holes, etc.) are similar to the dimensional features of conducting disks 36. Each conductor turn 42 incorporates at least one insulating disk 34 nested into the stack. FIG. 5 shows a detail of this arrangement. The reader will observe the upper portion and lower portion of each insulating disk 34 (both ends of each disk are labeled as "34" in the view so that the reader may easily distinguish them from conducting disks 36). The reader will also observe how each insulating disk 34 nests into the helix formed by the six conducting disks 36.

FIG. 7 also illustrates this arrangement. Insulating disk 34 is placed immediately over the first conducting disk 36. It then follows the same helical pattern as the conducting disk 18. Returning now to FIG. 4, the cumulative effect of this construction will be explained. The four conductor turns 42 shown in FIG. 4 are identical. When they are compressed together, the four insulating disks 34 will form one continuous helix through the stacked conducting disks 36. The insulating disks will then be positioned to form one continuous helical path through the stack. Thus, the construction disclosed forces a helical flow of electrical current through the device. An actual Bitter magnet might include 20 or more such conductor turns.

Those skilled in the art will realize that when a substantial electrical current is passed through Bitter magnet 32, strong mechanical forces are created (Lorentz forces). Significant heat is also introduced through resistive losses. Thus, the device must be able to withstand large internal mechanical forces, and it must also be able to dissipate heat. Once the entire device is assembled with the two end plates 40 in place, the end plates are mechanically forced toward each other. The lower ends of tie rods 44 are attached to the lower end plate 40. The upper ends pass through holes in the upper end plate 40. The exposed upper ends are threaded so that a set of nuts can be threaded onto the exposed ends of tie rods 44 and tightened to draw the entire assembly tightly together. In this fashion, the device is capable of resisting the Lorentz forces, which tend to move the disks and other components relative to each other.

Not all Bitter-type magnets use tie rods. Other mechanical structures can be used to align the components and resist the Lorentz forces. However, since tie rods are the most common approach, they have been illustrated.

Because Bitter magnet 32 generates substantial heat during operation, natural convective cooling is generally inadequate. Forced convective cooling, using deionized water, oil, or liquid nitrogen is therefore employed. A sealed cooling jacket is created by providing an inner cylindrical wall bounded on its lower end by the lower end plate 40, and bounded on its upper end by the upper end plate 42. An outer cylindrical wall is provided outside the outer perimeter of the disks, extending from the lower end plate 42 to the upper end plate 42. All the components illustrated are thereby encased in a sealed chamber. The liquid is then forced into the cooling jacket, where it flows from one end of the device to the other through the aligned cooling holes in the stacked disks (the cooling holes align in the conducting and insulating disks). In FIG. 4, the cooling flow would be linear from top to bottom or bottom to top.

Those skilled in the art will realize that the completed Bitter magnet 32 will generate an intense magnetic field within the cylindrical cavity within the inner cylindrical wall. Those skilled in the art will also realize that it is possible to generate an even greater magnetic field by nesting concentric Bitter-type coils. All these components are well known within the prior art.

The conducting disk shown in FIG. 6 uses round tie rod holes and round cooling holes. Any discontinuity in the cross section of the disk causes structural weakness and imperfections in the magnetic field produced. Viewed only from the standpoint of electromagnetic efficiency, the disk would ideally have no holes at all. Such a design would not work, though, since it could not be effectively cooled. The lack of tie rods would also prevent the disks being effectively aligned and clamped together in order to resist Lorentz forces. Thus, the design of a Bitter-type magnet inherently involves compromises between purity of the magnetic field, conductivity, mechanical strength, cooling, and other factors.

In recent years the traditional Bitter disk design has been improved to remedy some of its shortcomings. FIG. 8 shows a conducting disk developed at the national High Magnetic Field Laboratory in Tallahassee, Fla. This type of disk is now known as a Florida-Bitter disk.

As the tie rods are loaded primarily in tension, a non-round shape can be used. An elongated cross section for the tie rod provides a better compromise between the strength required and the space consumed. Such tie rods are now used. Florida-Bitter disk 56 has elongated tie rod holes 58 to accommodate the modified cross section of the tie rods.

Elongated cooling holes also provide a more advantageous strength versus cooling compromise. Florida-Bitter disk 56 has cooling slots 60 in place of the conventional cooling holes. A series of such cooling slots are placed in rings across the width of the disk.

FIG. 9 shows a detailed view of a portion of Florida-Bitter disk 56, wherein these features can be seen more clearly. The reader will observe that successive circumferential arrays of cooling slots are staggered. If one starts with the innermost array of slots, the next outward array is staggered so that the slots in that array are outboard of the webs in the preceding array. This staggering of the cooling slots substantially enhances the strength of the magnetic field created, and is an important feature of the Florida-Bitter disk.

From these descriptions, the reader will gain some understanding of the construction of high-field resistive magnets. All these techniques can potentially be used in constructing a magnet according to the present invention.

BRIEF SUMMARY OF THE INVENTION

The present invention comprises an electromagnet having a conical bore. The conical bore is created by wrapping a conductor around a conically-offset helix. The cross sectional area of the conductor can be varied in order to maintain a desired current carrying capacity along the helix. A single element can be used as the conductor. The conductor can also be created by stacking a series of specially-shaped plates analogous to prior art Bitter-disks.

REFERENCE NUMERALS IN THE DRAWINGS

| | | | |
|---|---|---|---|
| 10 | hybrid conical magnet | 12 | conical resistive magnet |
| 14 | jacket | 16 | superconducting magnet |
| 18 | beam | 20 | scattering angle |
| 22 | conical bore | 24 | cylindrical bore |
| 26 | Florida helix | 28 | gap |
| 30 | flat | 32 | Bitter magnet |
| 34 | insulating disk | 36 | conducting disk |
| 40 | end plate | 42 | conductor turn |
| 44 | tie rod | 46 | tie rod hole |
| 48 | lower side | 50 | upper side |
| 52 | cut | 54 | cooling hole |
| 56 | Florida-Bitter disk | 58 | elongated tie rod hole |
| 60 | cooling slot | 62 | polyhelix conical magnet |
| 64 | first helix | 66 | second helix |
| 68 | third helix | 70 | fourth helix |
| 72 | input | 74 | output |
| 76 | conical bore | 78 | conical Bitter magnet |
| 80 | first Bitter coil | 82 | second Bitter coil |
| 84 | third Bitter coil | 86 | conically offset Florida helix |
| 88 | cylindrical outer limit | 90 | variable section Florida helix |
| 92 | outer section | 94 | inner section |

-continued

| | | | |
|---|---|---|---|
| 96 | variable pitch | 97 | inner section disk |
| 98 | outer section disk | 100 | conductor |
| 102 | conical Florida-Bitter magnet | 104 | central bore |
| 106 | outer section | 108 | inner section |
| 110 | conductor cross section | 112 | inner edge |
| 114 | outer edge | 116 | upper edge |
| 118 | lower edge | 120 | conical profile |

DETAILED DESCRIPTION OF THE INVENTION

Figure 1:
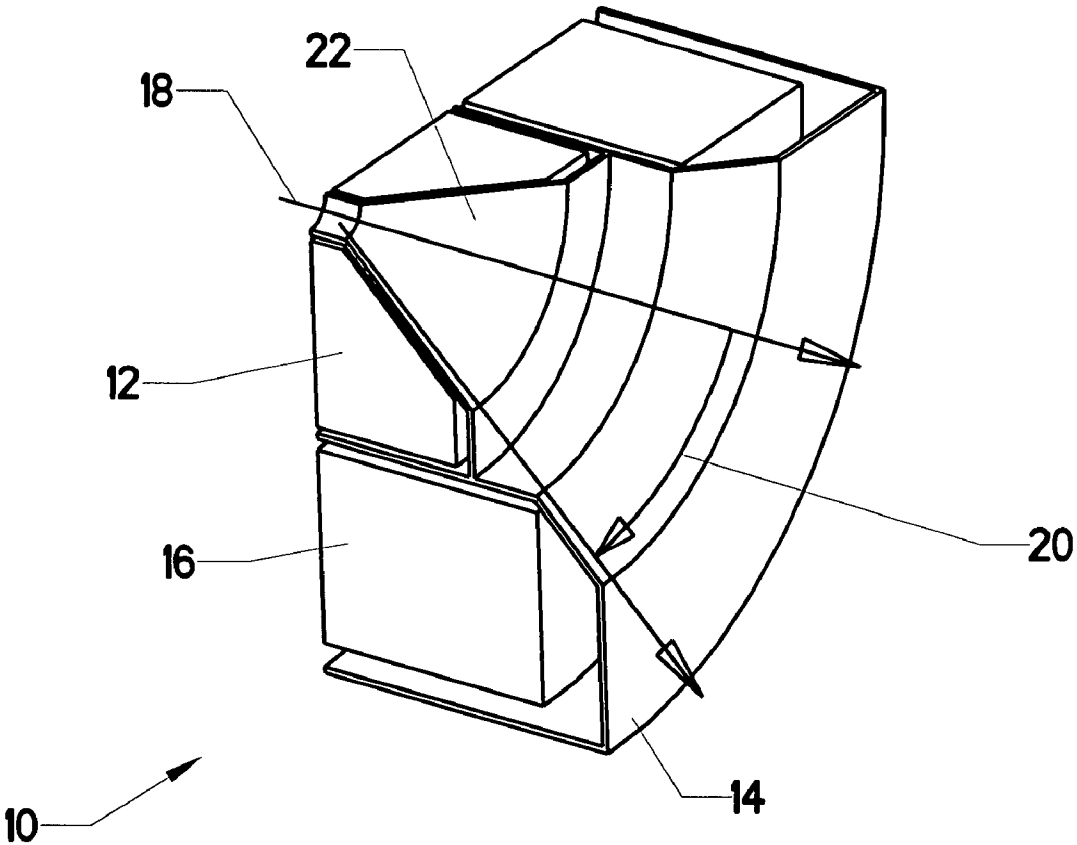
FIG. 1 is a sectioned perspective view, showing a magnet according to the present invention.

The present invention is a magnet having a conical bore. FIG. 1 is a simplified representation of ¼ of such a magnet. Conical resistive magnet 12 is created around a central axis (only 90 degrees of the 360 degree structure is shown). The resistive magnet includes a central cavity with a conical portion.

Superconducting magnet 16 surrounds conical resistive magnet 12. The result is a hybrid magnet. Both the resistive and superconducting portions are surrounded by a jacket 14. The jacket contains circulating cooling fluid and other associated hardware. Those skilled in the art will know that the actual structure of such a magnet is much more complex (including multiple jackets, insulation, cooling hardware, etc.). FIG. 1 only depicts the basic concepts.

Conical bore 22 is formed in conical resistive magnet 12. This conical bore will generate an unusual magnetic field. A beam 18 (typically comprised of photons or neutrons) entering the bore will be deflected through scattering angle 20. If a material sample is placed in the small portion of the conical bore, the beam will strike the material sample and be scattered in all directions. Detectors placed either upstream or downstream of the magnet will detect the scattered beam. Analysis of the data reveals much about the material sample.

Figure 2:
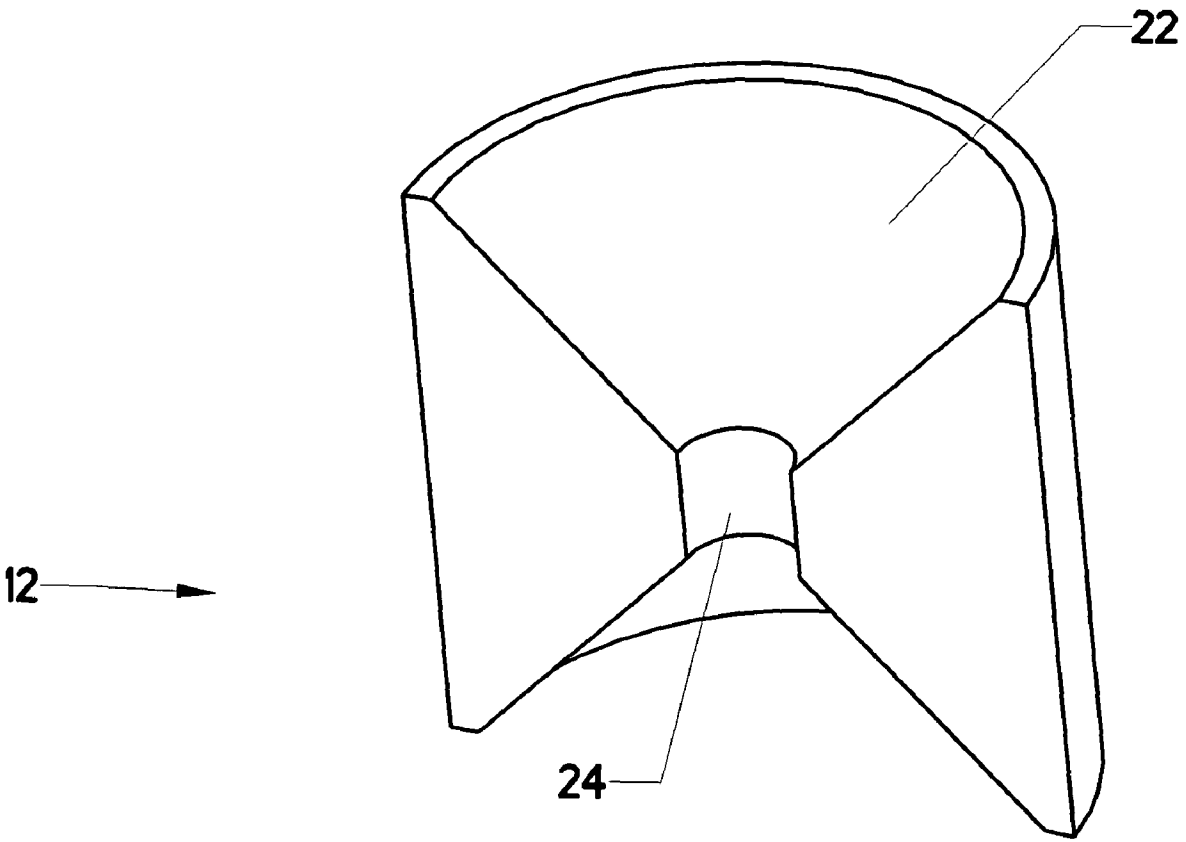
FIG. 2 is a sectioned perspective view, showing a simplified representation of a conical bore.

FIG. 2 shows ½ of a conical resistive magnet having two conical bores 22 joined by a cylindrical bore 24. Each conical bore has a small end and a large end. The cylindrical bore links the two small ends. The reader will note that FIG. 2 discloses no detail regarding how a conducting winding can be formed into the shape shown. Such a winding is a key element of the present invention.

Figure 10:
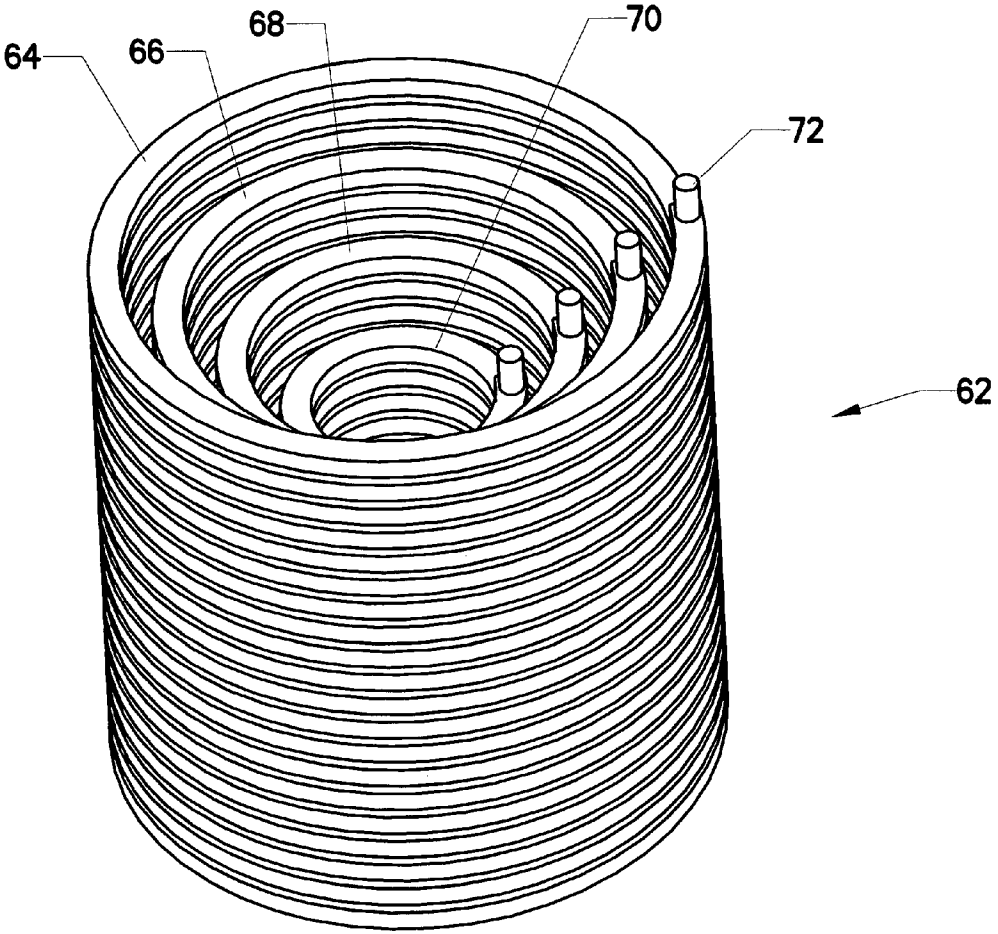
FIG. 10 is a perspective view, showing a polyhelix conical magnet.

The concept of a magnet having a conical bore is not new. However, practical designs for physically creating the conductive coil in such a magnet have been elusive. FIG. 10 shows an approximation of a conical bore using four nested helical windings, denoted as polyhelix conical magnet 62. The magnet includes first helix 64, second helix 66, third helix 68, and fourth helix 70. The conical bore is said to be an approximation because it is obviously formed as a series of steps.

Figure 11:
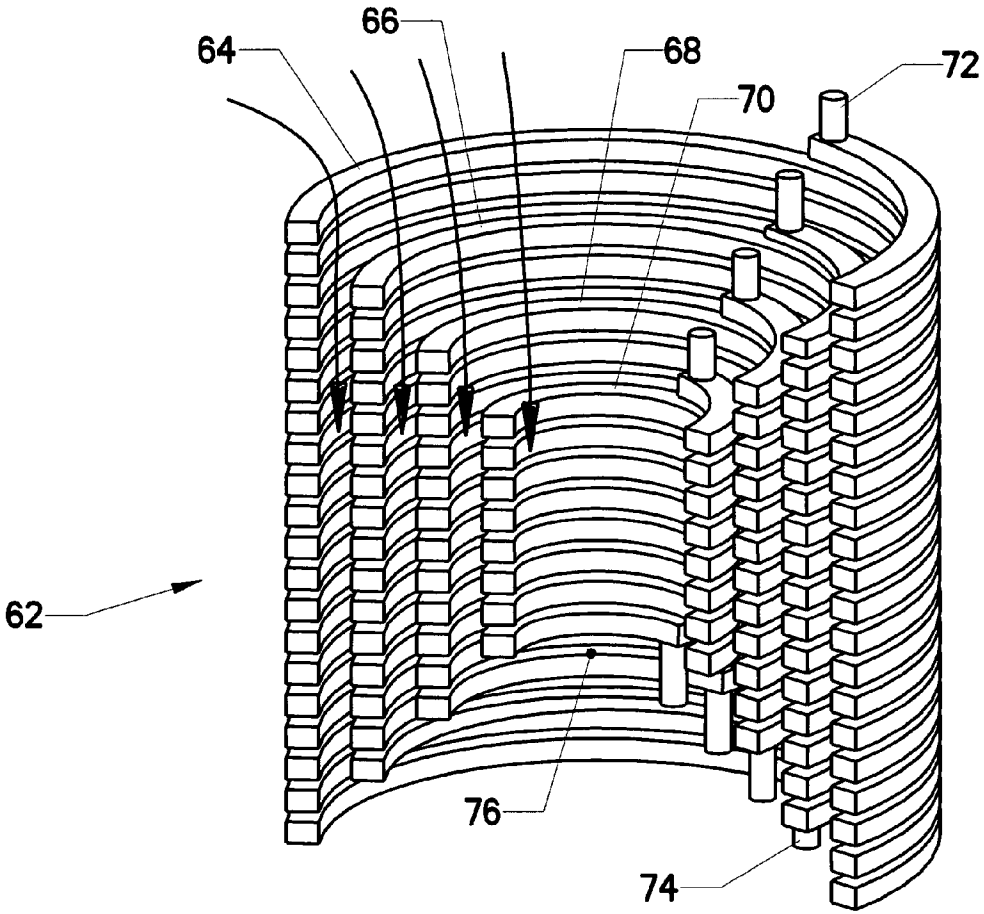
FIG. 11 is a sectioned perspective view, showing the interior of the magnet of FIG. 10.

FIG. 11 shows the same magnet with a cutaway to reveal its internal features. Each helix has an input 72 and an output 74 (feeding current into and out of each helix). The polyhelix approach requires each coil to be slender as each is only cooled along its inner and outer radius (The cooling flow is depicted by the arrows in the view). Additional space is required for bus bars and structure to resist the Lorentz forces and Lorentz-induced fault forces. Thus, the polyhelix approach is relatively inefficient due to these space requirements.

Figure 12:
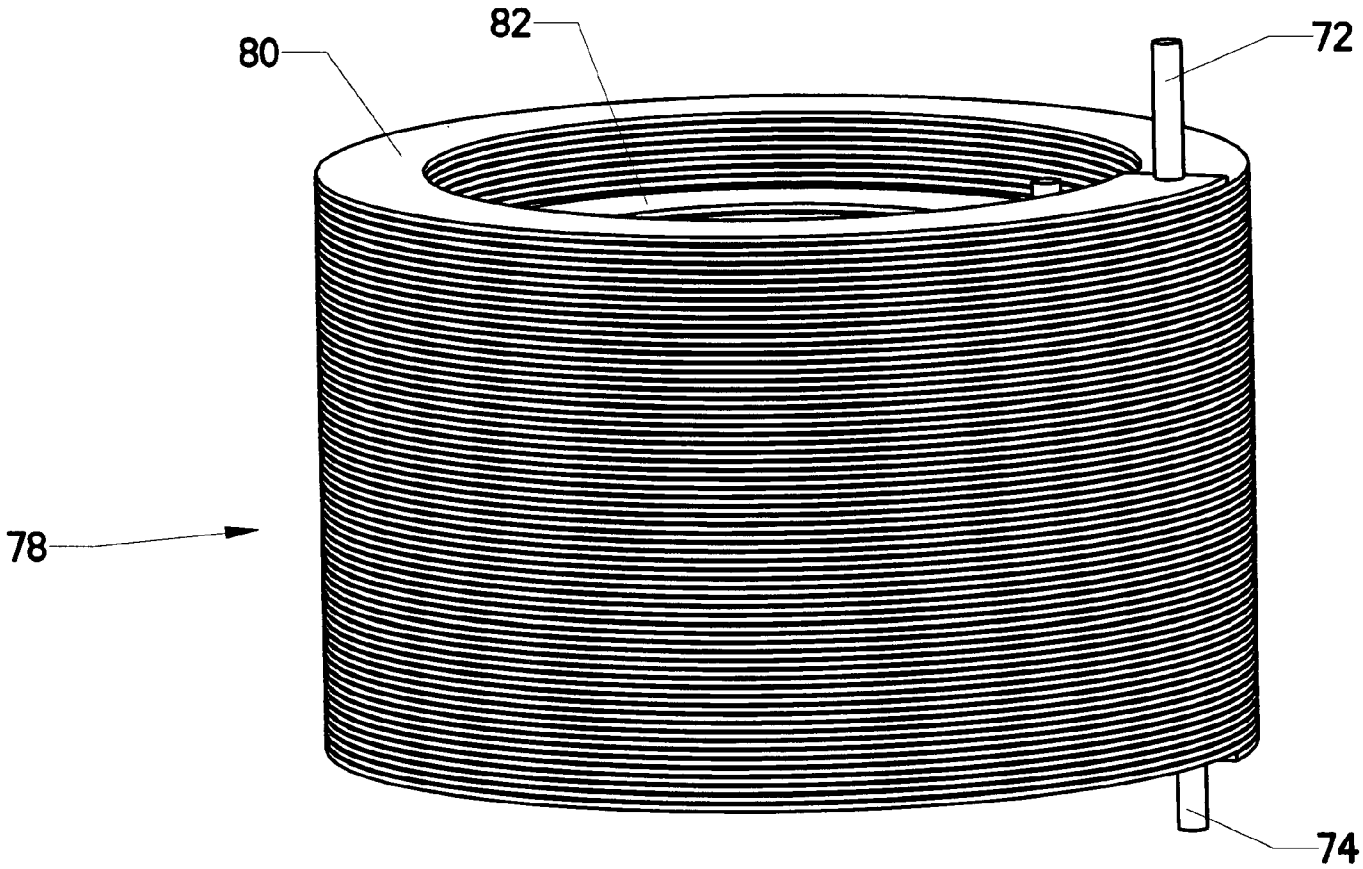
FIG. 12 is a perspective view, showing a conical Bitter magnet.
Figure 13:
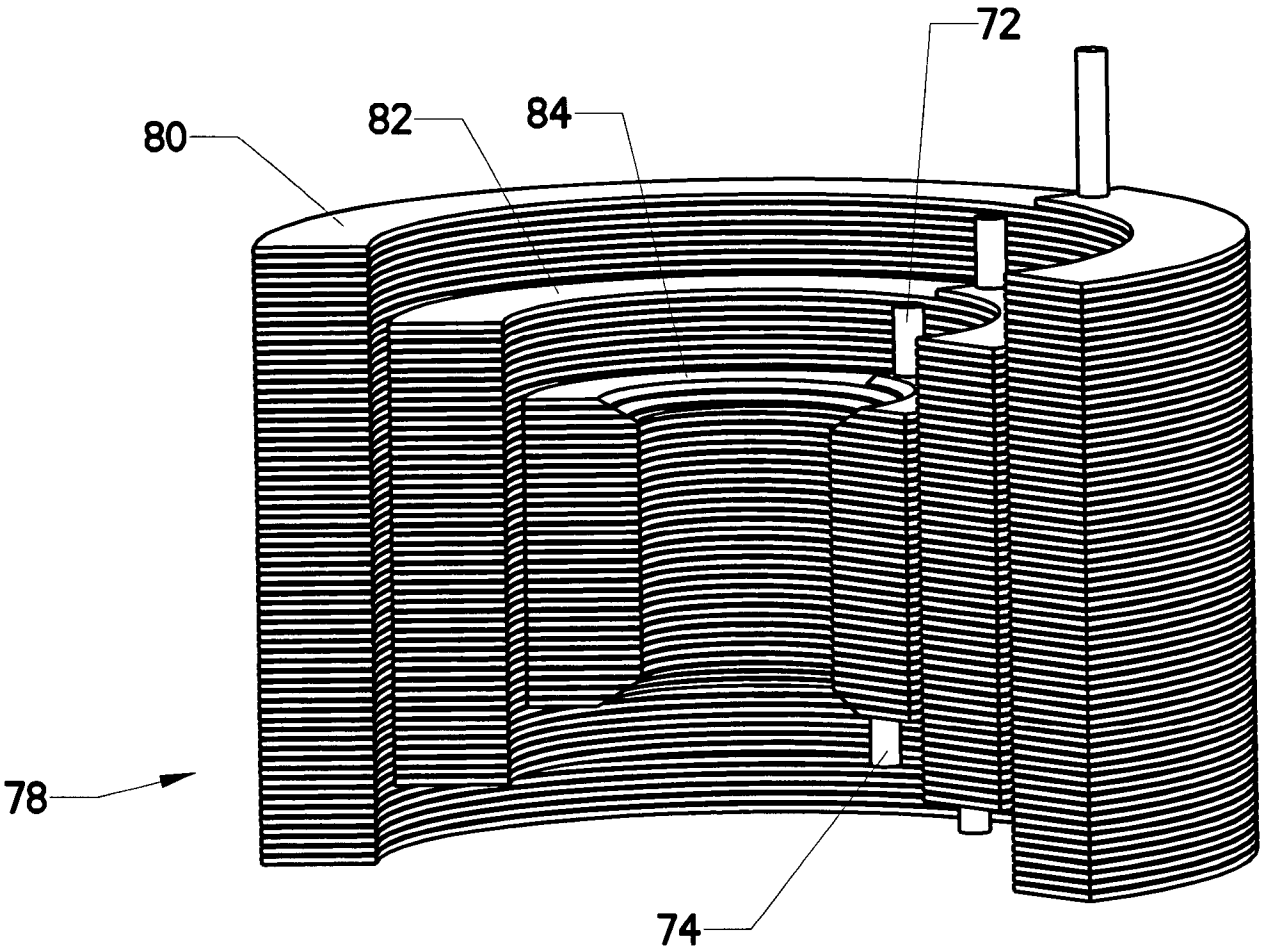
FIG. 13 is a sectioned perspective view, showing the interior of the magnet of FIG. 12.

FIG. 12 shows a conic approximation using concentric stacks of prior art Bitter disks, denoted as conical Bitter magnet 78. FIG. 13 shows a cutaway in this magnet to reveal its internal features. The magnet includes first Bitter coil 80, second Bitter coil 82, and third Bitter coil 84. Each coil is again fed by an input 72 and output 74. Each coil is made of a stack of Bitter disks, such as shown in FIGS. 4 through 7. Structural features such as the tie rods, cooling holes, and cooling jackets have been omitted for visual clarity.

The Bitter technology can employ thicker coils than the polyhelix approach, since the Bitter disks have internal cooling passages. This fact reduces the space lost to bus-bars and structure. However, a thicker Bitter coil can produce higher stresses and lower magnetic fields. Thus, an approach other than the polyhelix or Bitter technologies is desirable.

Figure 3:
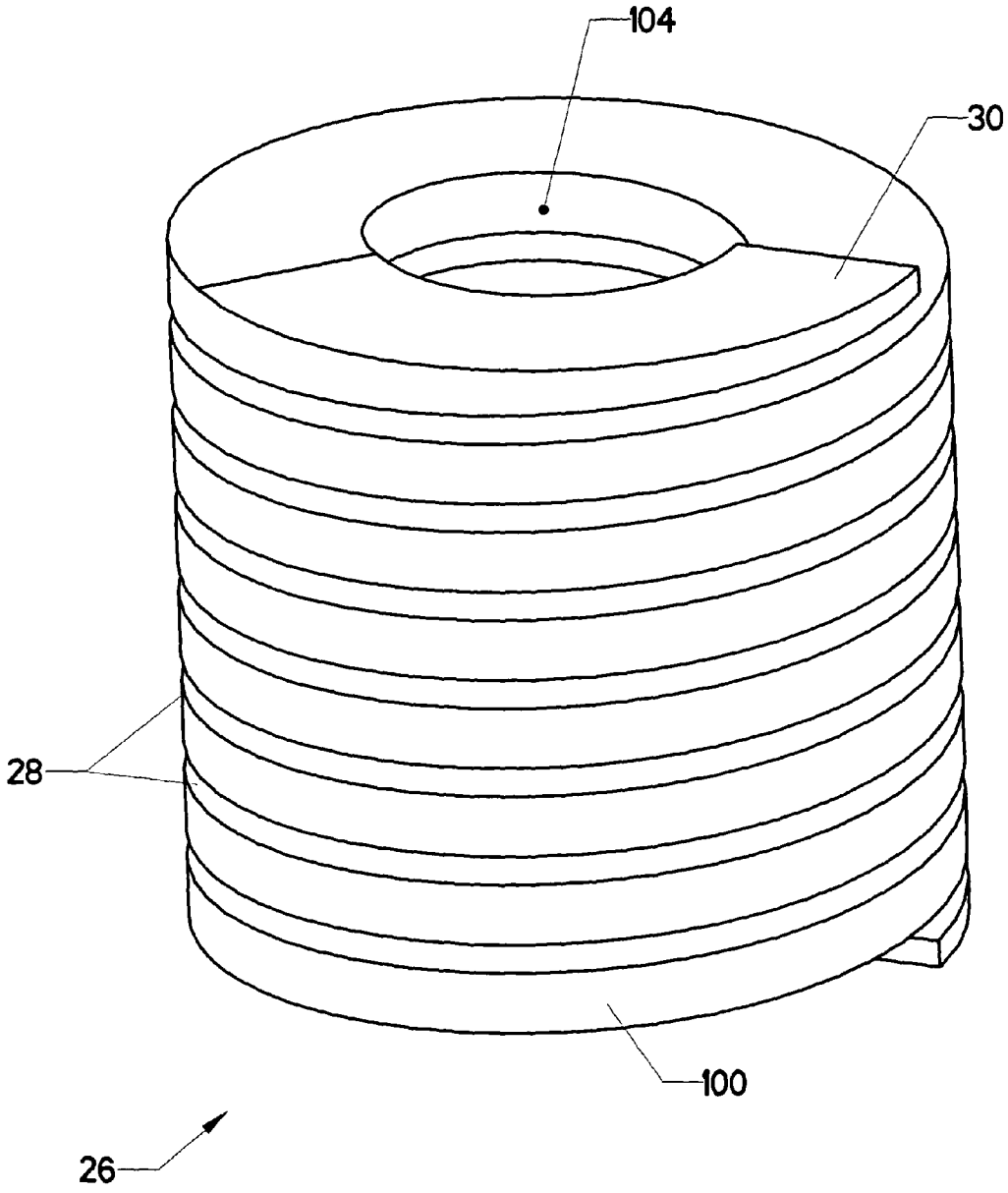
FIG. 3 is a perspective view, showing a conductive helix.
Figure 4:
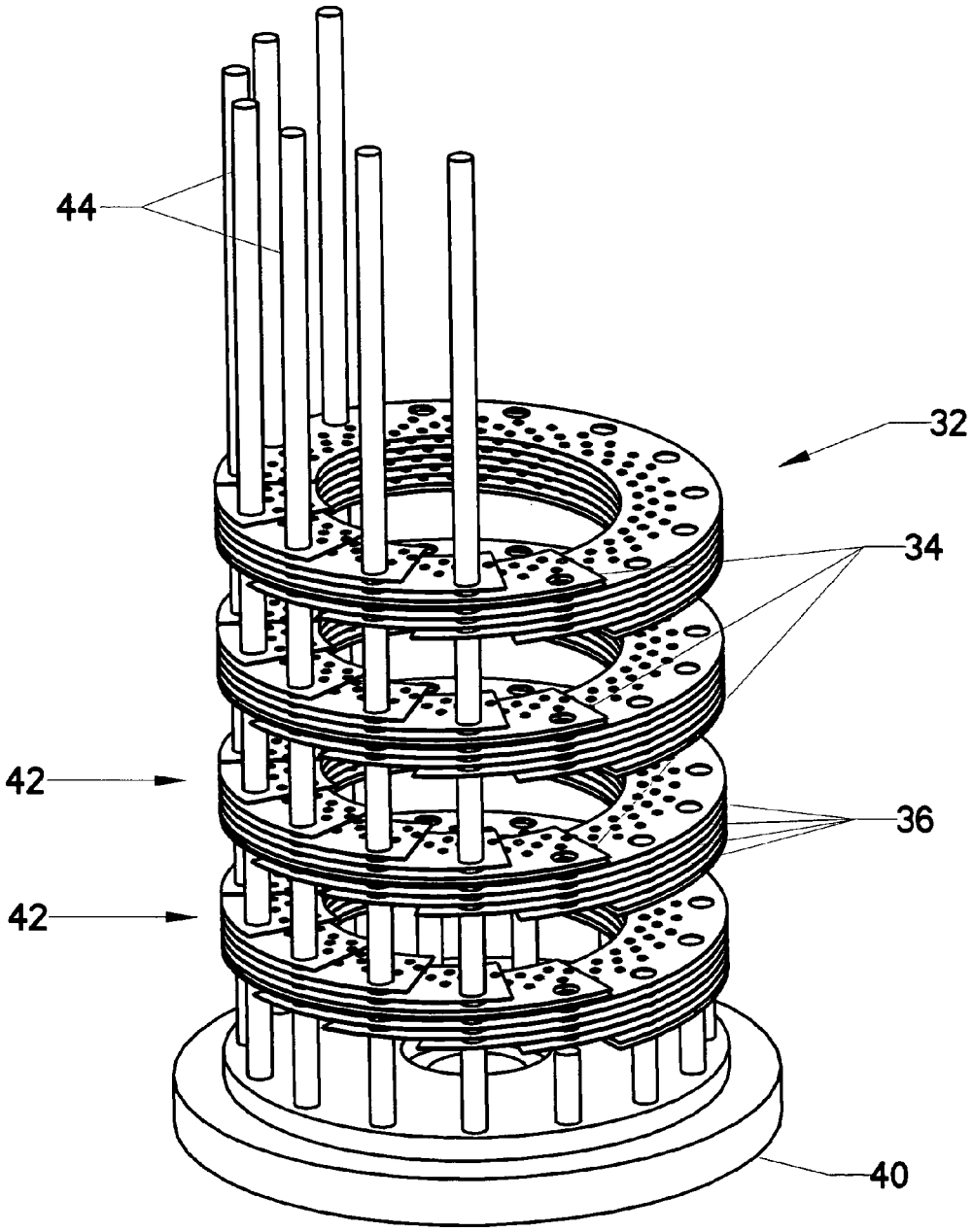
FIG. 4 (PRIOR ART)
FIG. 4 is a perspective view, showing a prior art Bitter-disk magnet.
Figure 5:
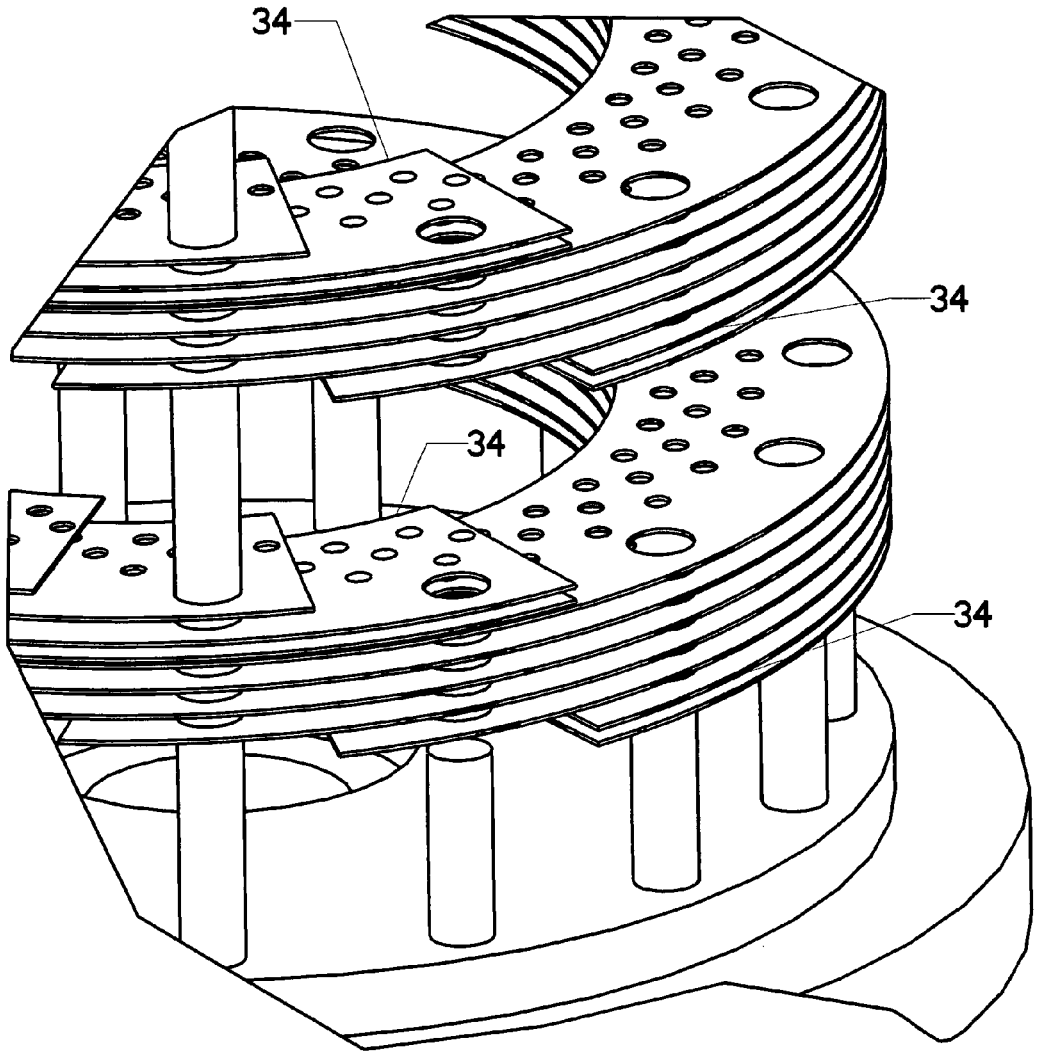
FIG. 5 (PRIOR ART)
FIG. 5 is a detail view, showing a portion of a Bitter-disk magnet.
Figure 6:
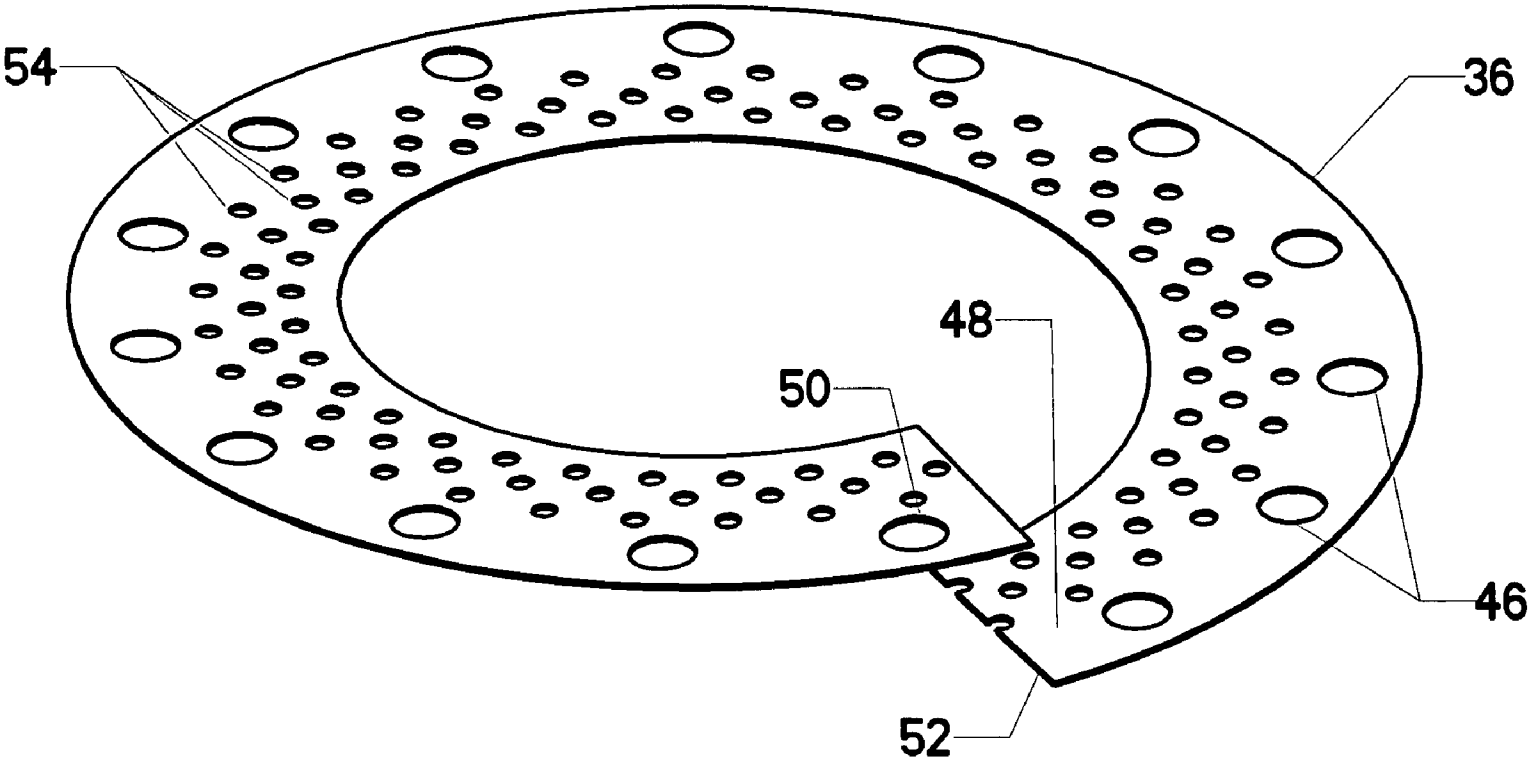
FIG. 6 (PRIOR ART)
FIG. 6 is a perspective view, showing a prior art Bitter-disk.
Figure 7:
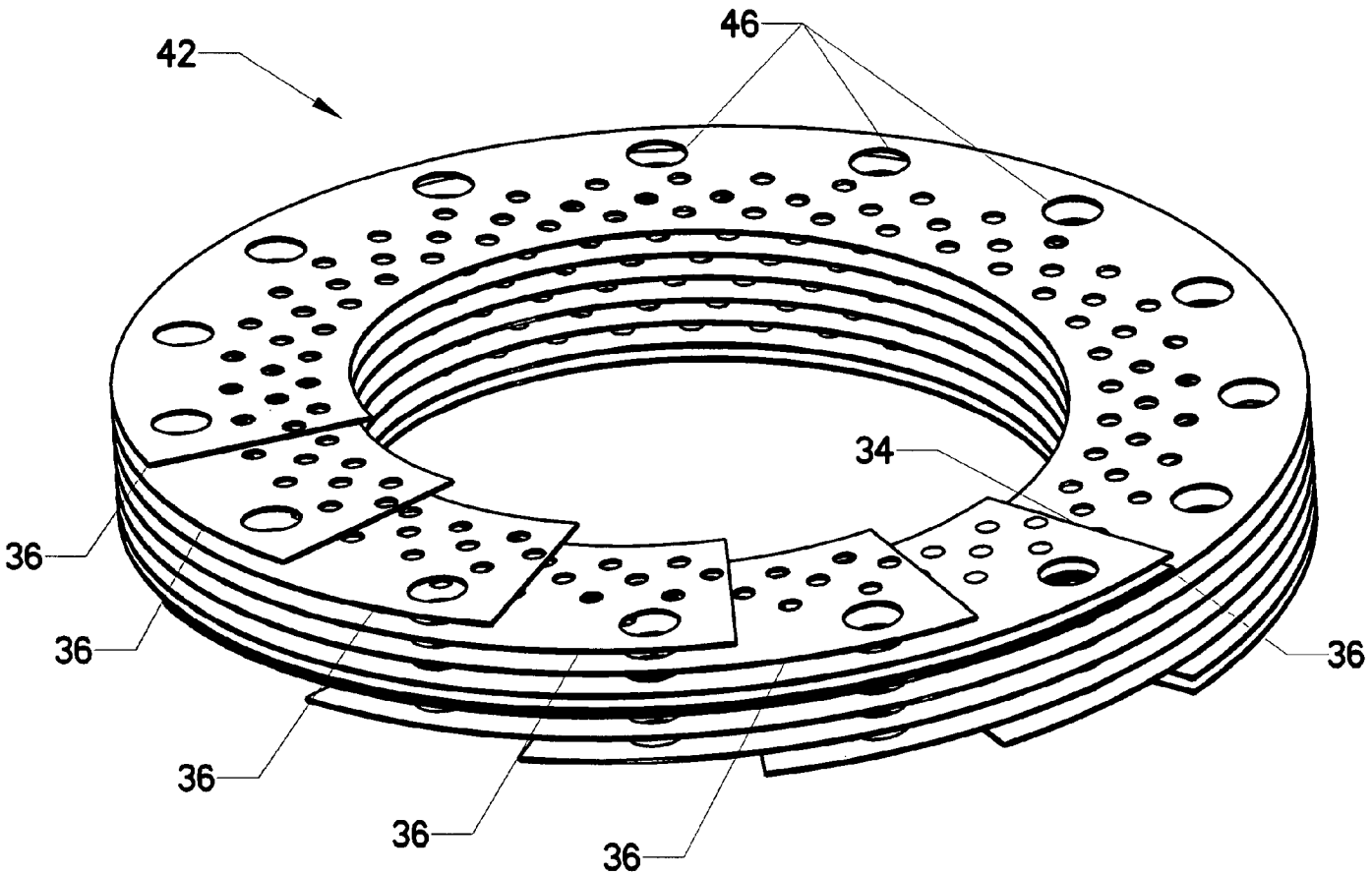
FIG. 7 (PRIOR ART)
FIG. 7 is a perspective view, showing a prior art Bitter-type conductor turn.
Figure 8:
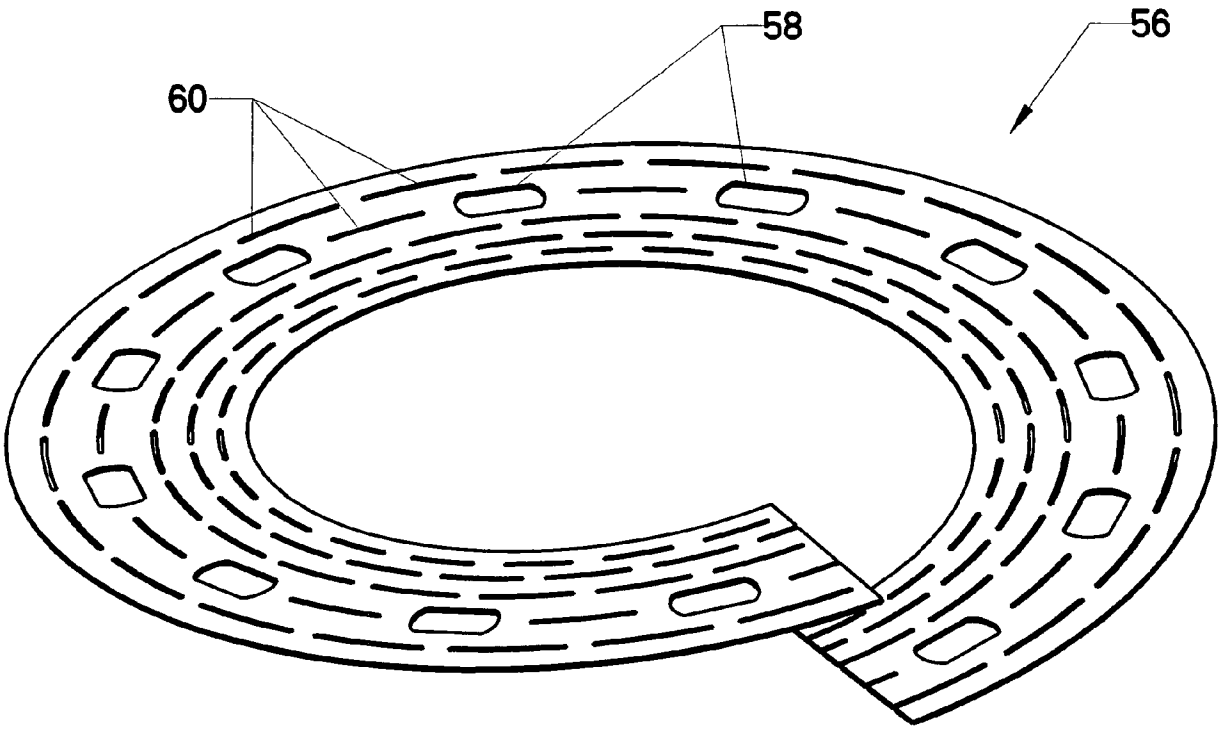
FIG. 8 (PRIOR ART)
FIG. 8 is a perspective view, showing a prior art Florida-Bitter disk.
Figure 9:
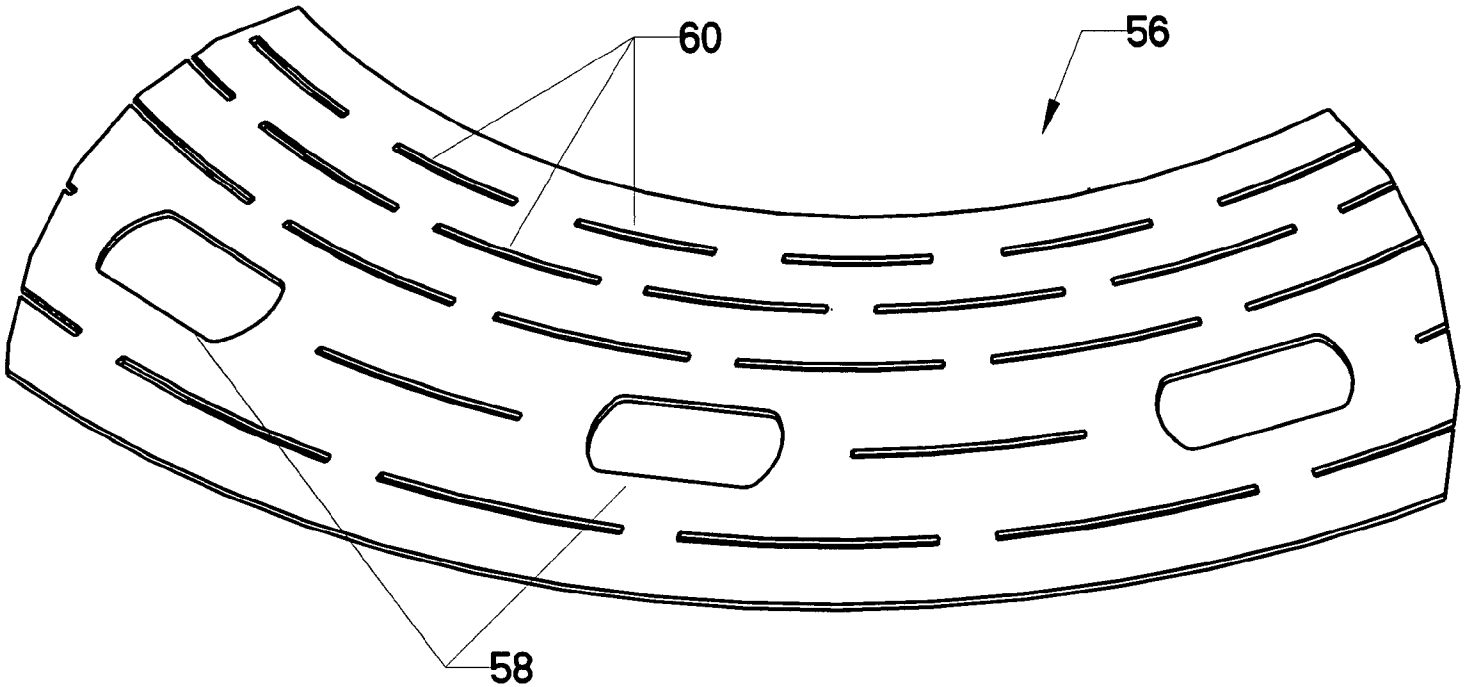
FIG. 9 (PRIOR ART)
FIG. 9 is a detail view, showing a portion of a Florida-Bitter disk.
Figure 14:
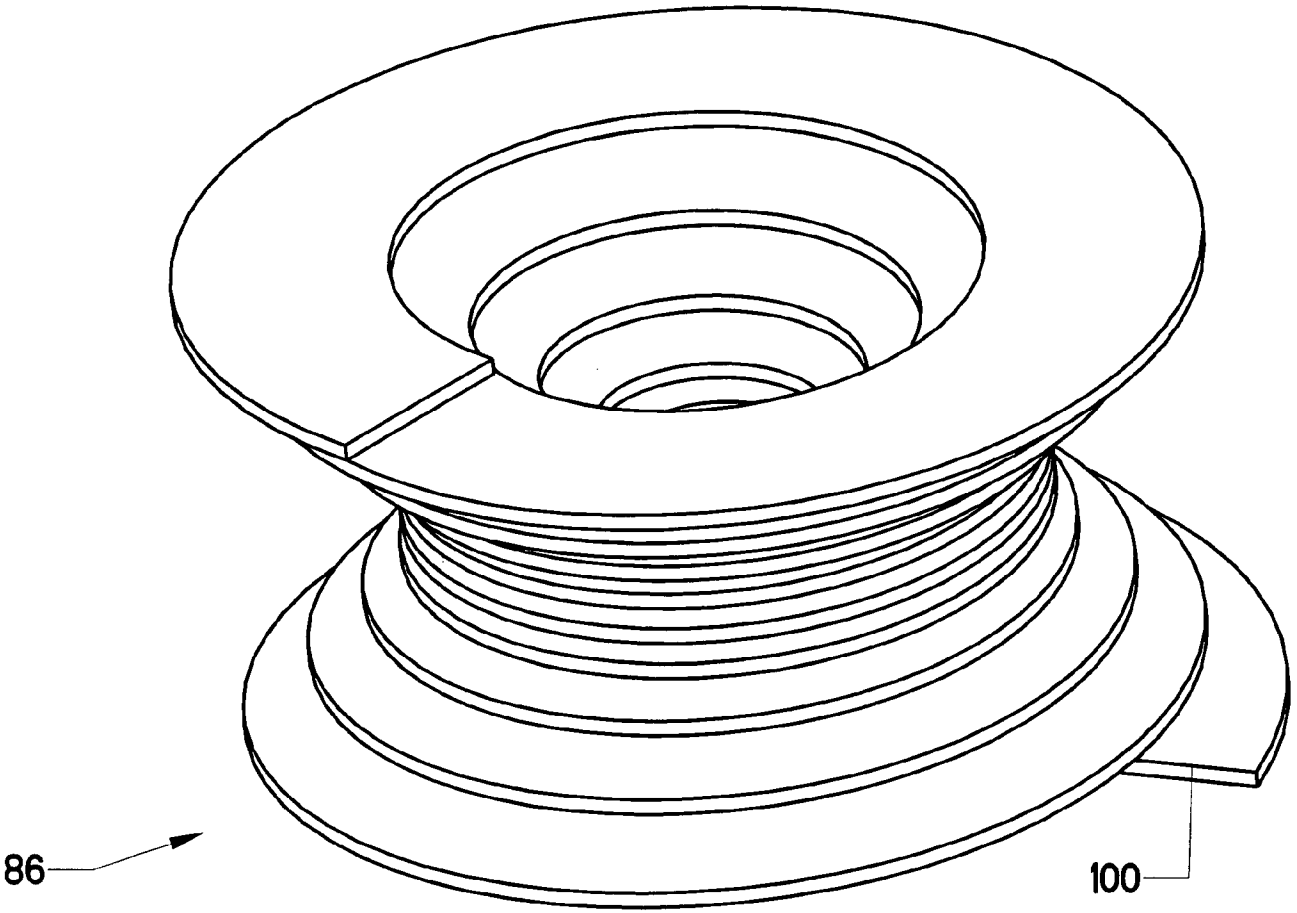
FIG. 14 is a perspective view, showing a conically offset Florida helix.

Returning briefly to FIG. 3, the reader will recall that Florida helix 26 uses a single piece of continuous conductive material (conductor 100) wrapped around a central bore 104. Such a design can be altered to form a conical magnet. FIG. 14 shows conically offset Florida helix 86. A conductor 100 is wound along an offset helical path to form two conical portions joined by a cylindrical portion (analogous to FIG. 2). The conical portions are actually a step-wise approximation of a purely conical surface. The term "conical portion" will be understood to encompass such a stepped approximation. Those skilled in the art will realize that a smaller step size will generally give a more accurate approximation, while a larger step size will generally give a more coarse approximation.

Figure 15:
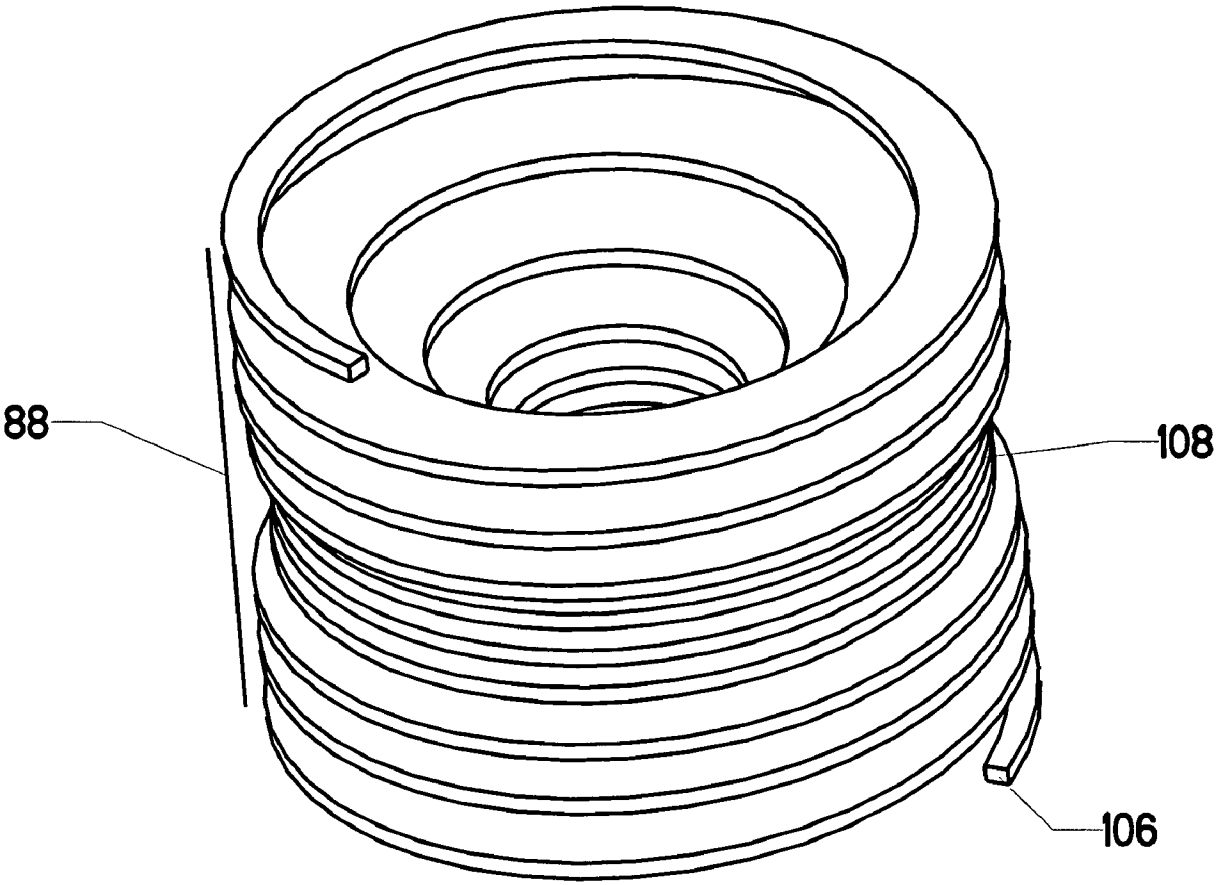
FIG. 15 is a perspective view, showing a conically offset Florida helix with a cylindrical exterior.
Figure 16:
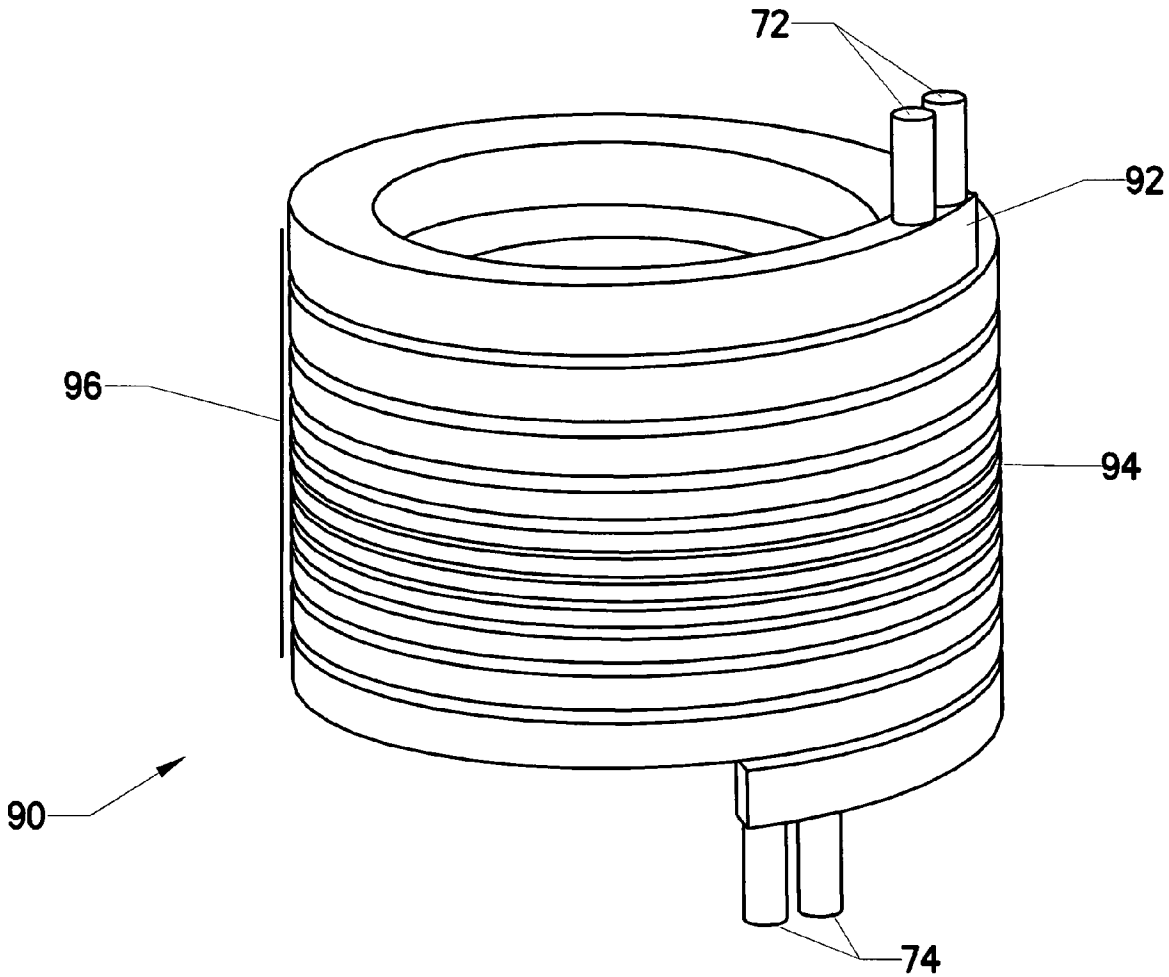
FIG. 16 is a perspective view, showing a variable section Florida helix.

A constant cross section is used for the conductor in the example of FIG. 14. However, unlike the idealized structure of FIG. 2, offset Florida helix 86 does not have a cylindrical exterior boundary. One can modify the structure of FIG. 14 by simply "cutting away" material on the exterior boundary to produce a cylindrical result. FIG. 15 shows this result, with the boundary labeled as cylindrical outer limit 88. The reader will immediately perceive a problem, however. Since all the turns of the conductor have a constant thickness, outer section 106 winds up having a much smaller cross-sectional area than inner section 108. The current-carrying capacity of the coil will therefore vary significantly from the outside of the coil to the center of the coil—an undesirable result. If, however, the pitch of the helix and the thickness of the conductor can be varied, a nearly uniform cross-sectional area can be produced. FIG. 16 illustrates such a structure, denoted as variable section Florida helix 90. The reader will note the presence of variable pitch 96. The thickness of the conductor also varies along the helix. Outer section 92 is relatively thick, but not very wide, whereas inner section 94 is thin but quite wide.

Figure 17:
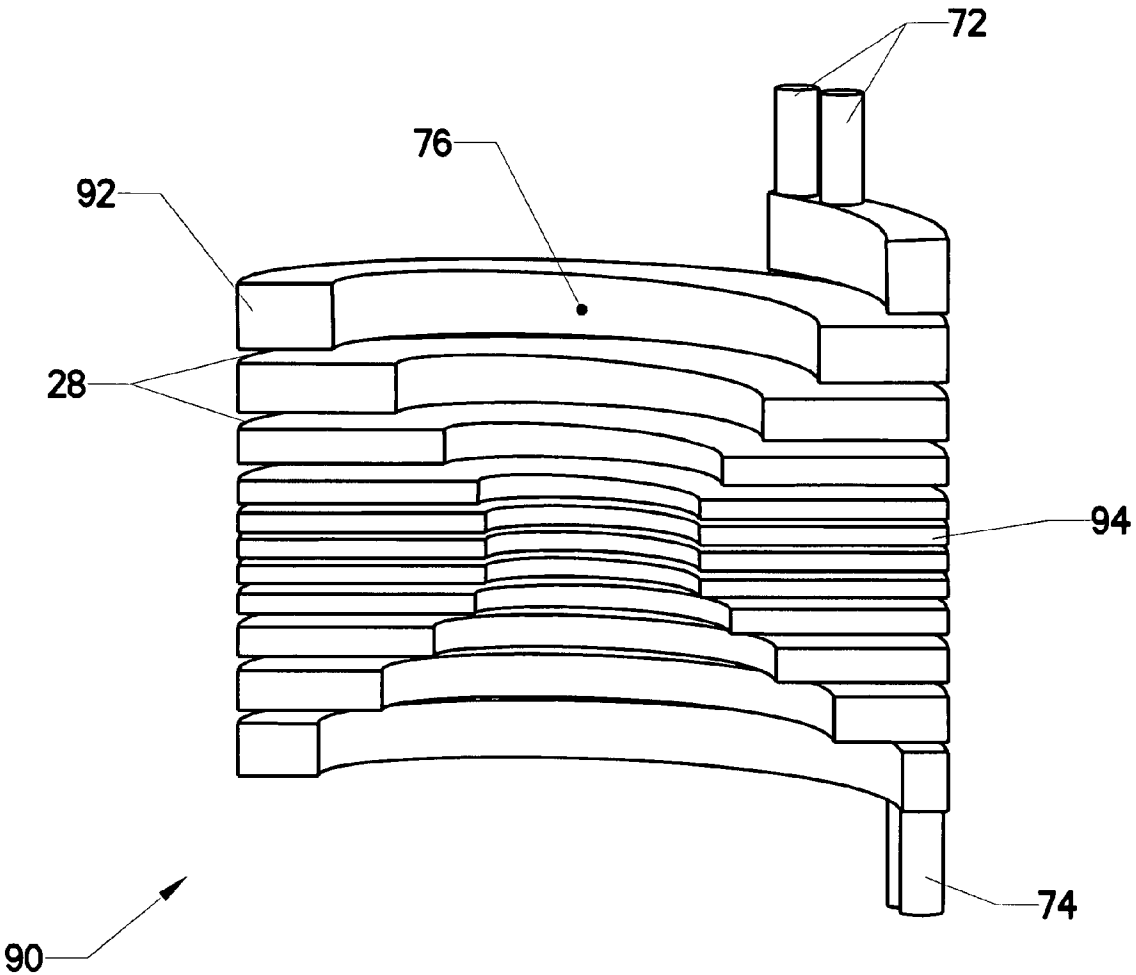
FIG. 17 is a sectioned perspective view, showing the interior of the magnet of FIG. 16.

FIG. 17 shows the same structure sectioned in half to reveal internal details. Conical bore 76 is produced by the conical offset in the coil. FIG. 17 clearly shows the variation in pitch, section width, and section thickness. By varying the pitch and cross section of the helical conductor, the current carrying capacity along the helix can be altered. It can be made uniform. It can also be made lower near the outer sections than in the middle. This may be desirable to maximize the magnetic field to power ratio. It can also be made higher near the outer sections than in the middle, if so desired.

Manufacturing a structure such as depicted in FIGS. 16 and 17 can be quite difficult. One approach is to cut the inside and outside profile from a solid billet of material on a lathe. The outside profile is simply cylindrical. The inside profile is a helical step. A helical slot having varying thickness and varying pitch is then sliced into the turned billet using a wire EDM machine (forming the helical path of gap 28). Either the feed spool or take-up spool of the wire EDM must be placed inside conical bore 76, with the other spool being placed outside.

The result is a modified type of Florida-helix. This structure can be used for the conical resistive magnet shown in FIG. 1. Other features must be added as well. For instance, an insulating material is needed within gap 28 to prevent a short circuit in the conductive path. This insulating material could be a separate piece or—more likely—an assembly of several separate pieces such as for the prior art Bitter-type magnets. Other structural support elements are needed. Cooling openings cut from top to bottom (with respect to the orientation shown in the view) will also be needed.

Figure 18:
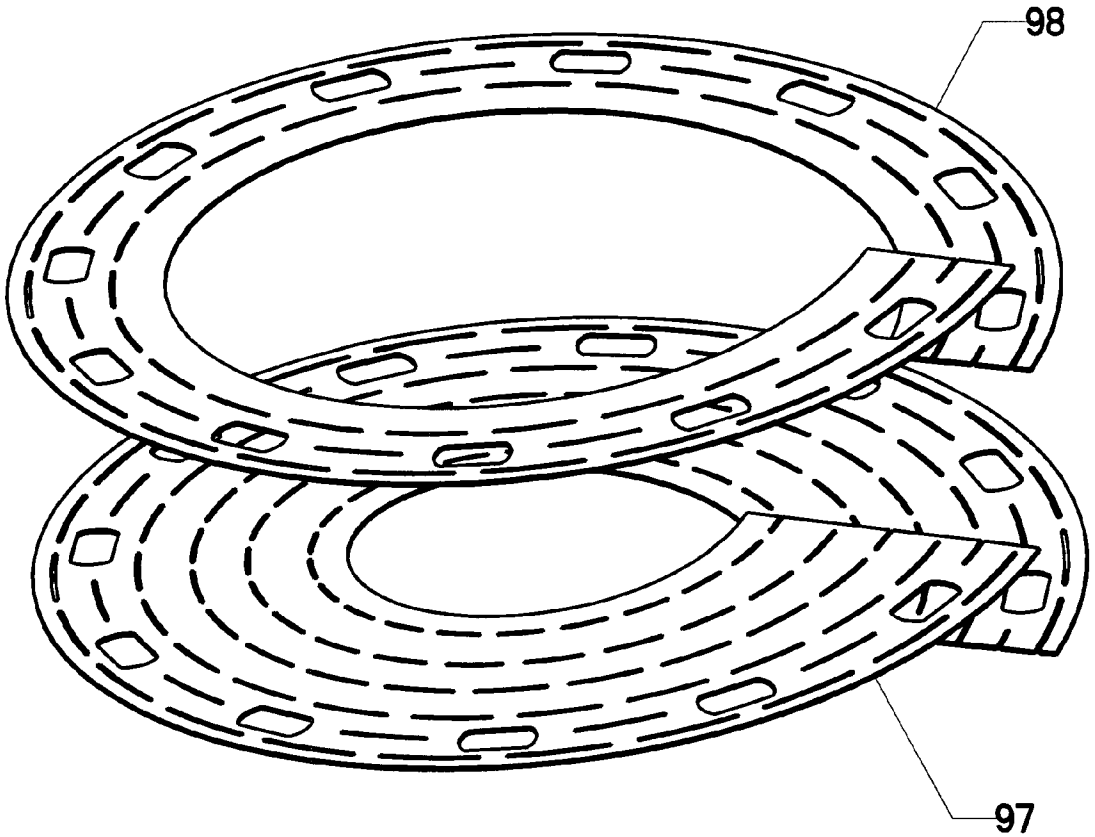
FIG. 18 is a perspective view, showing the use of Florida-Bitter disks to construct a coil such as the one shown in FIGS. 16 and 17.

Of course, the creation of such a modified Florida-helix is quite complex. It may be simpler to create the device using stacked Florida-Bitter disks (creating a structure analogous to that shown in FIG. 4). The prior art Florida-Bitter disks will have to be modified to create the variable cross sections. FIG. 18 shows two Florida-Bitter disks modified in this way.

Outer section disk 98 is sized to fit within the profile of outer section 92 in FIG. 17. Inner section disk 97 is sized to fit within the profile of inner section 94 in FIG. 17. Tie rod holes and cooling slots are provided within these Florida-Bitter disks. The cooling slots near the outer perimeter are aligned to allow cooling flow from top to bottom in the stacked magnet. The cooling slots near the inner perimeter may be staggered to allow coolant to flow into the thicker conical portion near the magnet's middle.

Figure 19:
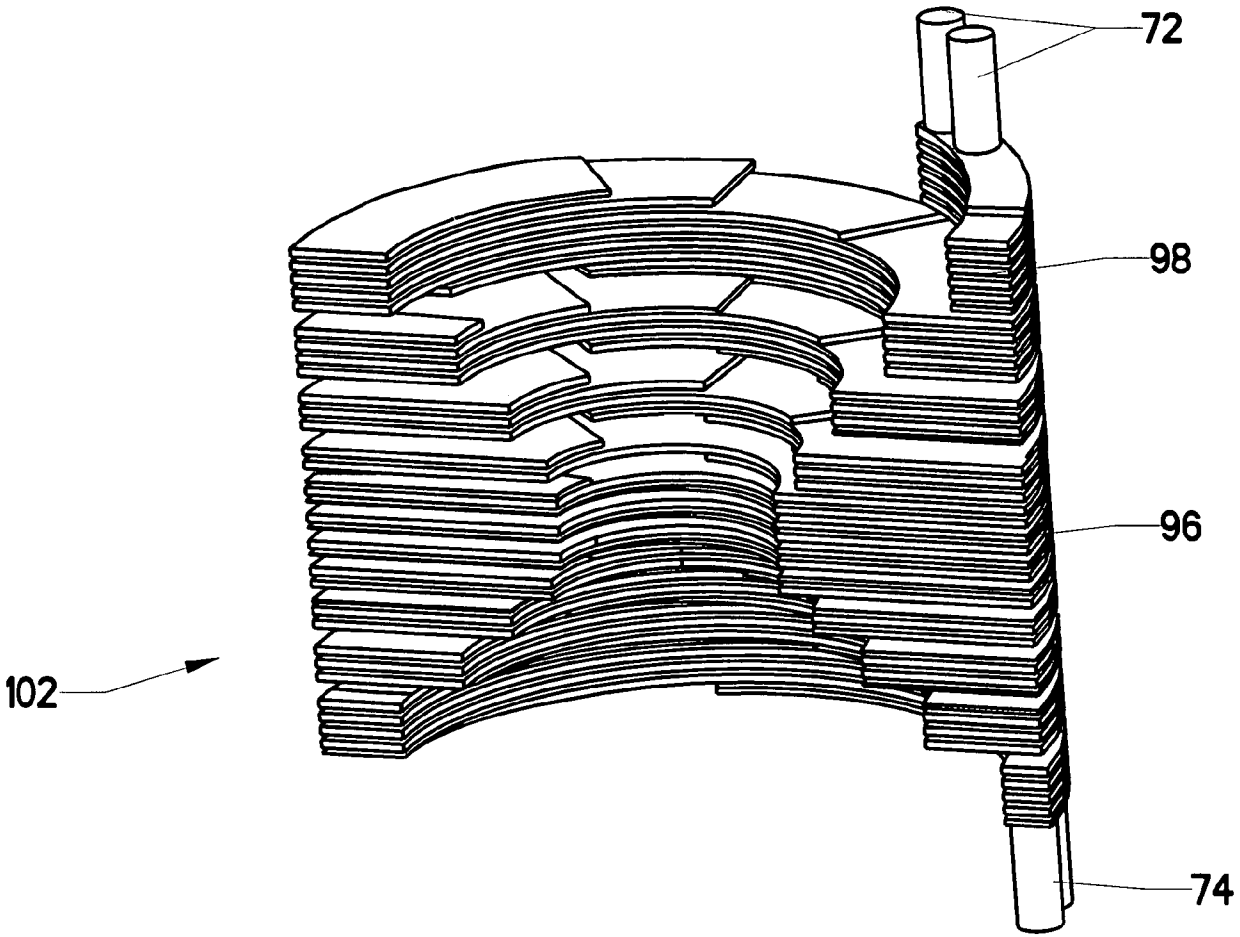
FIG. 19 is a sectioned perspective view, showing the use of Florida-Bitter disks to create a conical coil.

FIG. 19 shows a stack of specially configured Florida-Bitter disks. The reader will observe that the disks are stacked and rotationally indexed as in the prior art. However, the cross section of the successive disks are modified so that the completed stack approximates the conductor shape shown in FIG. 17. All the prior art features used in Bitter-type magnets will be present as well. Insulating disks must be used to force the current to flow in the helical path. Cooling slots and tie rod holes must be used as well (assuming tie rods are used). These features have not been illustrated in FIG. 19 in order to avoid visual complexity.

However, by studying FIG. 19, those skilled in the art will understand how the variable section Florida helix of FIG. 17 can be implemented using a set of specially shaped Florida-Bitter disks. The resulting magnet can then serve as conical resistive magnet 12 in FIG. 1.

Figure 20:
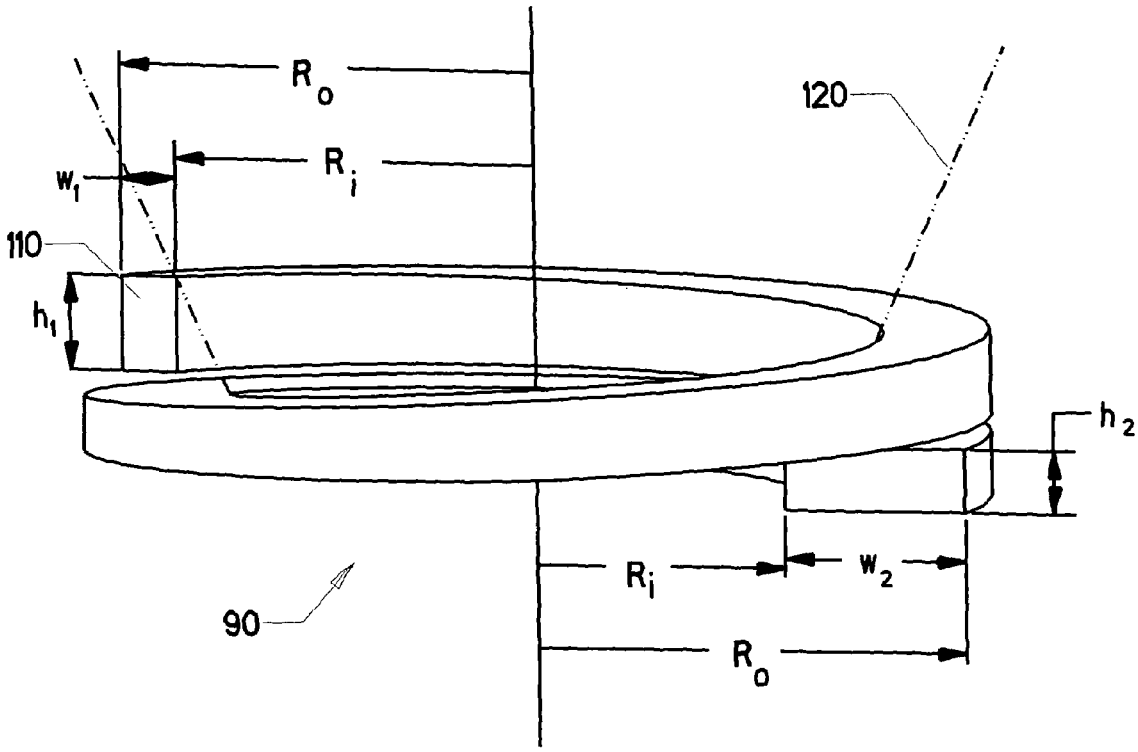
FIG. 20 is a perspective view with cutaways, revealing the nature of the varying conductor cross section within the helix.

Some additional explanations regarding the structure of a Florida-helix configured to have a conical bore may prove helpful to the reader's understanding. FIG. 20 shows the upper portion of a Florida-helix so configured. The conductor path is cut so that only 1 and ½ turns of the helix are shown. Two cross sections of the conductor are visible. The upper cross section has a height $h_1$ and a width $w_1$. The lower cross section has a height $h_2$ and a width $w_2$. The helix has a central axis as shown. The outer edge of the conductor lies along a fixed radius $R_o$ (which remains constant since the outer edge of the conductor cross section lies on a cylindrical surface, as explained previously). The inner edge of the conductor cross section lies along a variable radius $R_i$. Variable radius $R_i$ changes in order to create the conical inner profile of the helix.

The reader will observe that the height of the conductor cross section smoothly decreases from the upper cross section to the lower cross section. The width of the conductor cross section smoothly increases from the upper cross section to the lower cross section. The pitch is of course the distance between turns in a direction that is parallel to the central axis. The pitch of the helix must change in order to maintain approximately the same separation between successive turns. If the pitch did not change (and the cross section height was decreasing as shown), then the gap between successive turns would increase.

Figure 21:
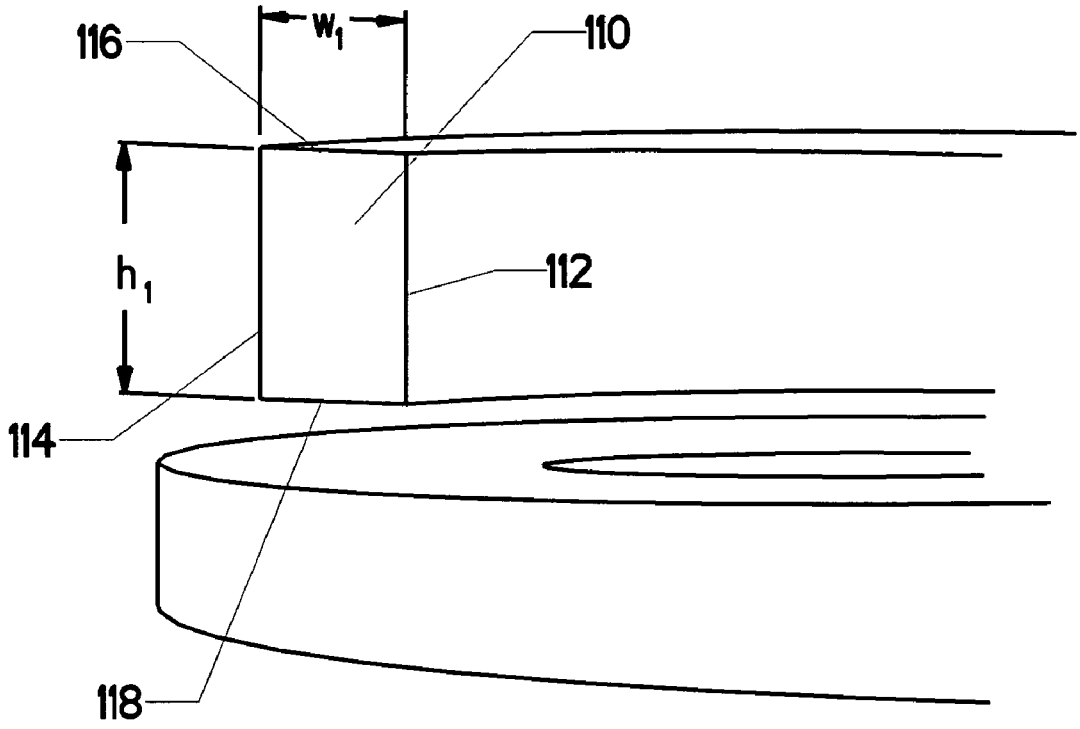
FIG. 21 is a detailed perspective view, showing an enlargement of the features shown in FIG. 20.

FIG. 21 shows a detailed view of the upper cross section of FIG. 20. The cross section is rectangular (or very nearly so). It is bounded by upper edge 116, lower edge 118, inner edge 112, and outer edge 114. The inner and outer radii are also labeled in the view. The cross section may vary slightly from a pure rectangle owing to the slope of the conductor along the helix and other factors. One other factor is the fact that a gap must be cut between successive turns of the conductor. This gap will ultimately be filled by an insulating material to ensure that the electrical current flows through the helical path. However—owing to fabrication concerns—it may be necessary to make the gap wider during fabrication than it will ultimately be with the conductor and the insulator(s) are in position for use. The conductor and the insulator are often compressed together, which will narrow the gap. This compression compresses the helix and may slightly tilt the conductor cross section.

As mentioned previously, the height and width of the conductor cross section smoothly changes throughout the helical path. The smooth transition in the height and width of the conductor cross section is readily apparent in FIG. 17 (which shows the structure of FIG. 16 sectioned in half) as well as FIGS. 20 and 21. The section varies from the top to the middle, and then from the middle to the bottom. The structure is approximately symmetric about the mid plane (a plane which is perpendicular to the central axis and placed in the middle of the structure). The reader will observe that the pitch decreases when moving from the top toward the middle, stabilizes in the middle, and then increases when moving from the middle to the bottom.

FIG. 17 shows two portions of the helical conductor having an internal profile which is approximately conical. The conical portions have an area of relatively large diameter (where the inner radius defining the inner edge of the cross section is large) tapering to an area of relatively small diameter (where the inner radius is relatively small). A cylindrical bore optionally links the two conical portions.

The reader will also observe how the conductor cross section changes, which can be summarized as follows: (1) the conductor cross section height decreases from the top to the middle, stabilizes in the middle, then increases again from the middle to the bottom; (2) the conductor cross section width increases from the top to the middle, stabilizes in the middle, then decreases again from the middle to the bottom.

Figure 22:
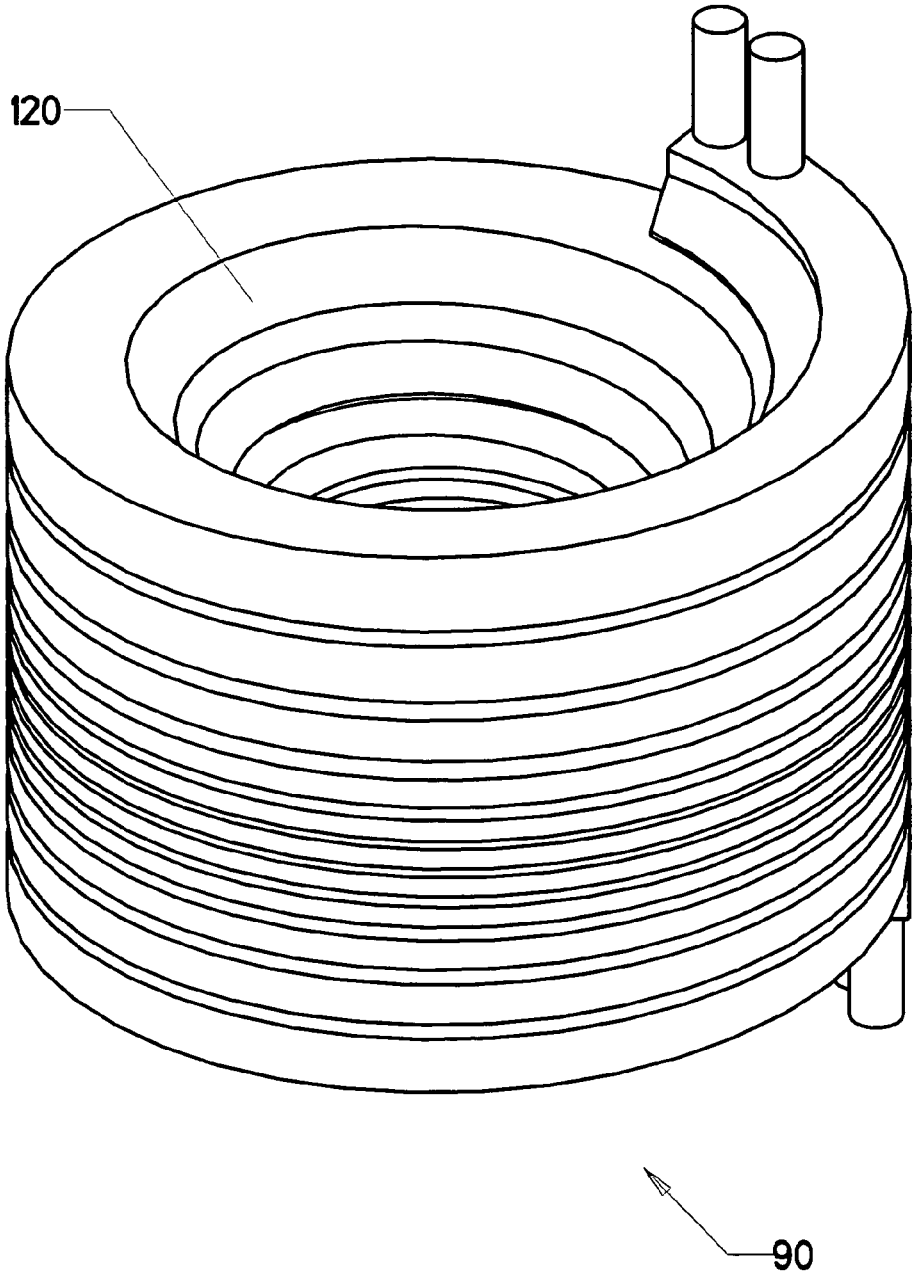
FIG. 22 is a perspective view, showing a variable section Florida helix having a conical inner surface.
Figure 23:
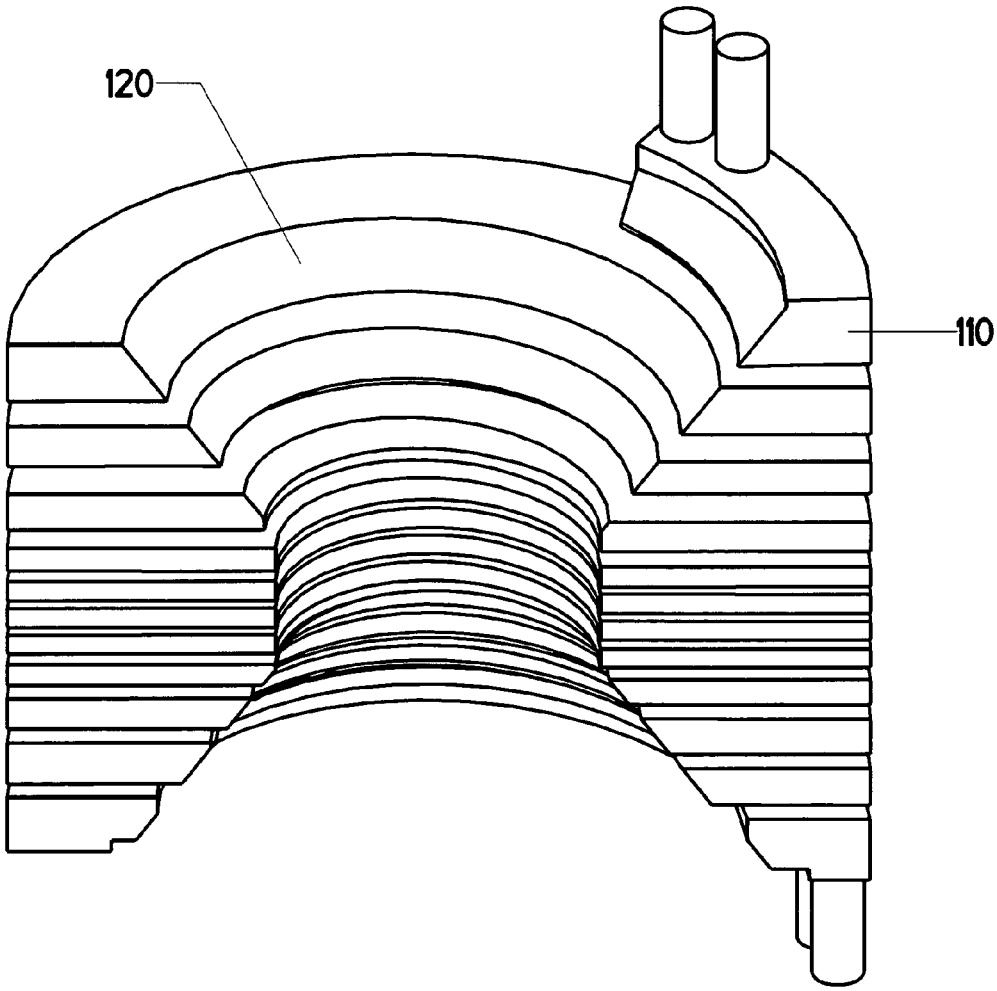
FIG. 23 is a sectioned perspective view, showing the helix of FIG. 22 sectioned in half.
Figure 24:
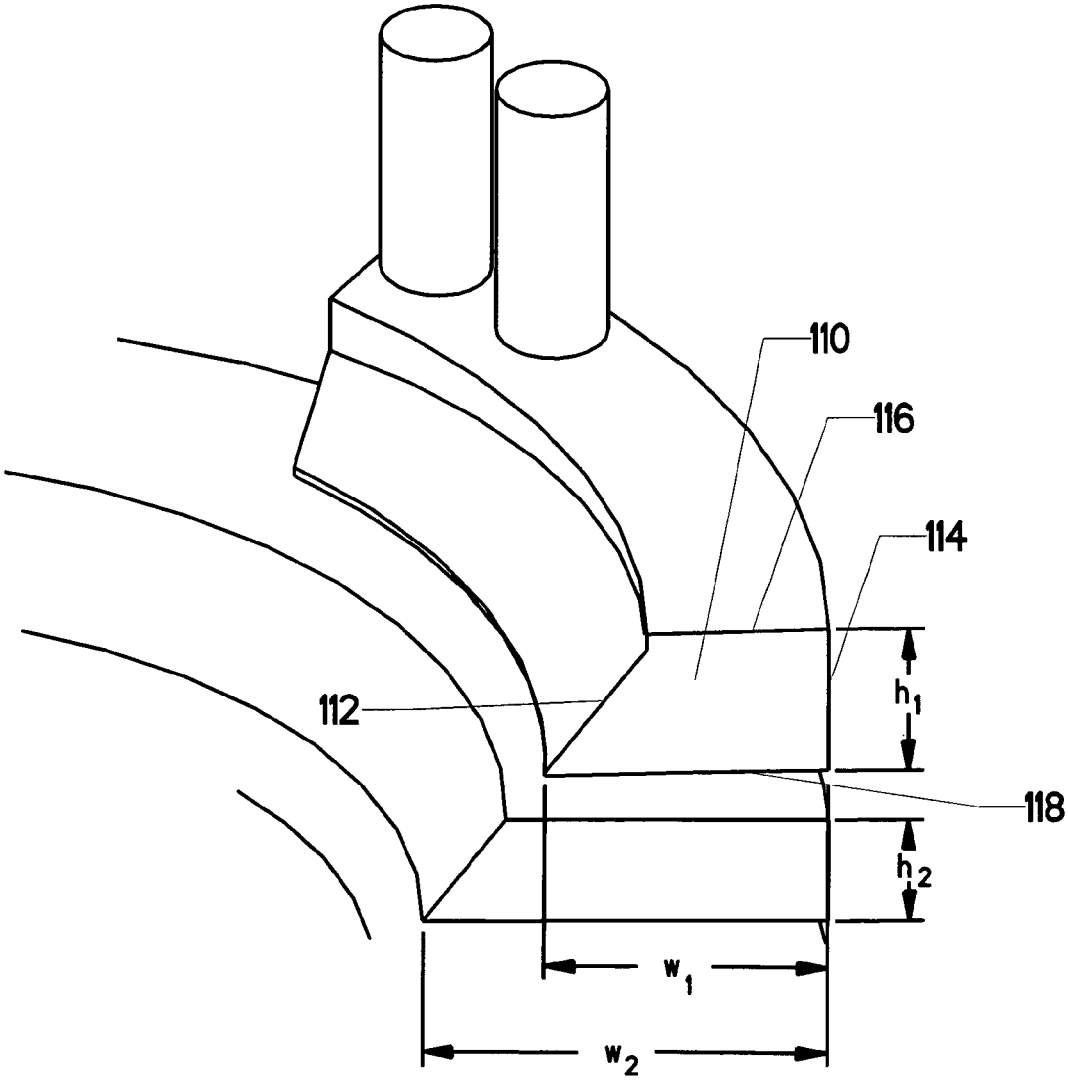
FIG. 24 is a detailed perspective view, showing an enlargement of the features shown in FIG. 23.

The embodiment shown in FIGS. 16, 17, 20, and 21 approximates the desired conical bore using steps. In some instances it may be more desirable to use a shape which more closely follows that of a true cone. FIGS. 22-24 show such an embodiment. In FIG. 22, variable section Florida-helix 90 features a conical profile 120 on the inner surface of the helix. FIG. 23 shows the same structure sectioned in half to show the nature of the conductor cross section as it winds from the top, through the middle, and ultimately to the bottom (directional terms such as "top" and "bottom" should be understood to refer to the orientations shown in the views, and should not be construed as imposing absolute limitations). The reader will observe how the height ad width of the conductor cross section smoothly varies as it winds from top to middle to bottom. However, the reader will also observe that the conductor cross section is no longer rectangular. It now assumes the form of a trapezoid.

FIG. 24 shows some of the conductor cross sections from FIG. 23 in greater detail. Inner edge 112 is sloped in order to define conical profile 120. This slope persists through the upper and lower regions of the helix. However, the variations in the conductor cross section's width and height exist as for the embodiment of FIGS. 16, 17, 20, and 21. Only the inner edge is different.

The use of a variable cross section allows a desired current density to be created in the different regions of the helix. Current density can be increased by using a relatively small cross sectional area for the conductor cross section and decreased by using a relatively larger cross sectional area for the conductor cross section. The use of the variable cross section also allows the pitch of the helix to be changed in order to create a greater number of turns (and therefore a greater field strength) in certain regions.

One option is to vary the height and width of the cross section in order to maintain a constant cross sectional area. A constant cross-sectional area may not always be desirable, however, as it may sometimes be preferable to vary the cross sectional area in order to create greater or lesser current densities in certain areas (other concerns such as cooling capacity may dictate these decisions). Thus, the invention is certainly not restricted to maintaining a constant or near-constant cross-sectional area. It also encompasses varying the height and width of the conductor cross section to create any number of desired variances in the cross-sectional area. However, these variances will be smooth transitions between local or global maxima and minima, as opposed to abrupt steps.

A magnet using this approach can be made using one or two conical portions. A version having two conical portions is preferably symmetric about a mid plane. A magnet thus constructed would be characterized as having:

(1) A helical conductor path with a varying pitch, where the pitch decreases from the top to the middle, stabilizes in the middle, and increases from the middle to the bottom;

(2) A variable conductor cross section in which the height and the width of the conductor smoothly vary as the helix winds around the central axis;

(3) Variable conductor cross section height in which the height decreases from the top to the middle, stabilizes in the middle, and then increases from the middle to the bottom;

(4) Variable conductor cross section width in which the width increases from the top to the middle, stabilizes in the middle, and then decreases from the middle to the bottom;

(5) An outer edge of the conductor cross section which lies on a fixed radius from the central axis in order to create a cylindrical outer surface for the helix; and (6) An inner edge of the conductor cross section which lies on a variable inner radius from the central axis, whereby the varying inner radius is used to create a conical (or approximately conical) inner surface for the helix.

Although a hybrid magnet has been illustrated in FIG. 1, the reader should not think of the invention as being limited to hybrid magnets. The conical resistive magnet could be used by itself, or in combination with other coils of many types. The embodiments illustrated and described should be viewed as exemplary, with the full scope of the invention being defined by the following claims.

Having described our invention, we claim:

1. An electromagnet capable of creating a conical magnetic field, comprising:

a. a center axis running from a first end of said electromagnet to a second end of said electromagnet;

b. a central cavity, lying within said electromagnet and running along said center axis;

c. wherein said central cavity includes a first conical portion defined by a conical profile;

d. a single helical conductor, wrapped around said first conical portion, wherein said single helical conductor is formed by a plurality of 360 degree turns;

e. wherein said single helical conductor has a pitch and a cross section;

f. wherein said pitch of said single helical conductor varies across said first conical portion;

g. wherein said cross section of said single helical conductor has an inner edge, an outer edge, a height, and a width;

h. wherein said outer edge lies upon an outer radius measured from said center axis, with said outer radius being constant;

i. wherein said inner edge lies upon an inner radius measured from said center axis, with said inner radius being variable within said first conical portion, so that said radius lies on said conical profile within said first conical portion, thereby smoothly varying said width of said cross section within said first conical portion; and j. wherein said height of said cross section is also smoothly varied within said first conical portion in order to maintain a desired cross sectional area for said cross section.

2. The electromagnet as recited in claim 1, wherein said pitch and said cross section are varied in order to maintain a constant cross sectional area of said helical conductor.

3. The electromagnet as recited in claim 2, wherein said pitch and said cross section of said helical conductor are varied to minimize the variation in said cross sectional area of said helical conductor throughout said first conical portion.

4. The electromagnet as recited in claim 3, further comprising:

a. wherein said first conical portion has a first end wherein said inner radius is relatively large and a second end wherein said inner radius is relatively small;

b. a second conical portion within said central cavity;

c. wherein said second conical portion has a first end wherein said inner radius is relatively large and a second end wherein said inner radius is relatively small; and d. wherein said second end of said first conical portion lies proximate said second end of said second conical portion.

5. The electromagnet as recited in claim 2, further comprising:

a. wherein said first conical portion has a first end wherein said inner radius is relatively large and a second end wherein said inner radius is relatively small;

b. a second conical portion within said central cavity;

c. wherein said second conical portion has a first end wherein said inner radius is relatively large and a second end wherein said inner radius is relatively small; and d. wherein said second end of said first conical portion lies proximate said second end of said second conical portion.

6. The electromagnet as recited in claim 1, wherein said helical conductor has an outward facing surface, and wherein said outward facing surface lies along a single cylinder running parallel to said center axis.

7. The electromagnet as recited in claim 1, further comprising:

a. wherein said first conical portion has a first end wherein said inner radius is relatively large and a second end wherein said inner radius is relatively small;

b. a second conical portion within said central cavity;

c. wherein said second conical portion has a first end wherein said inner radius is relatively large and a second end wherein said inner radius is relatively small; and d. wherein said second end of said first conical portion lies proximate said second end of said second conical portion.

8. The electromagnet as recited in claim 7, wherein said central cavity includes a cylindrical bore positioned between said first and second conical portions.

* * * * *